US009511483B2

(12) United States Patent
Taylor, Jr.

(10) Patent No.: US 9,511,483 B2
(45) **Date of Patent: *Dec. 6, 2016**

(54) SOCKET INSERT ADAPTER AND METHOD OF USE

(71) Applicant: James W. Taylor, Jr., Medford, OR (US)

(72) Inventor: James W. Taylor, Jr., Medford, OR (US)

( * ) Notice: Subject to any disclaimer, the term of this patent is extended or adjusted under 35 U.S.C. 154(b) by 273 days.

This patent is subject to a terminal disclaimer.

(21) Appl. No.: 14/287,261

(22) Filed: May 27, 2014

(65) Prior Publication Data

US 2014/0251092 A1 Sep. 11, 2014

Related U.S. Application Data

(63) Continuation of application No. 13/283,499, filed on Oct. 27, 2011, now Pat. No. 8,752,455, which is a continuation-in-part of application No. 12/434,609, filed on May 1, 2009.

(51) Int. Cl.

| | |
|---|---|
| ***B25B 13/58*** | (2006.01) |
| ***B25B 13/06*** | (2006.01) |
| ***B25B 13/10*** | (2006.01) |
| ***B25B 13/56*** | (2006.01) |

(52) U.S. Cl.

CPC ..... *B25B 13/58* (2013.01); *B25B 13/06* (2013.01); *B25B 13/065* (2013.01); *B25B 13/107* (2013.01); *B25B 13/56* (2013.01)

(58) Field of Classification Search

CPC ... B25B 13/58; B25B 13/107; B25B 13/065; B25B 13/06; B25B 13/56

USPC ..... 81/185, 121.1

See application file for complete search history.

(56) References Cited

U.S. PATENT DOCUMENTS

| | | | | |
|---|---|---|---|---|
| 710,164 | A * | 9/1902 | Murray | B25B 13/102 81/185 |
| 939,788 | A * | 11/1909 | Bartok | B25B 13/463 81/185 |
| 1,494,513 | A * | 5/1924 | Stewart | B25B 13/463 81/124.5 |
| 2,322,856 | A * | 6/1943 | Le Roue | B25B 13/107 76/114 |
| 2,376,676 | A | 5/1945 | Cronan | |
| 3,802,303 | A | 4/1974 | Evans et al. | |
| 4,620,462 | A | 11/1986 | Parker | |
| 4,836,067 | A | 6/1989 | Rogers et al. | |
| 6,354,175 | B1 | 3/2002 | Dobson et al. | |
| 6,901,824 | B1 * | 6/2005 | Chen | B25B 23/0035 81/121.1 |
| D550,049 | S * | 9/2007 | Peng | D8/29 |
| 7,406,895 | B2 * | 8/2008 | Hu | B25B 13/065 81/121.1 |
| D599,634 | S | 9/2009 | Taylor | |
| D611,789 | S | 3/2010 | Taylor | |

(Continued)

FOREIGN PATENT DOCUMENTS

| | | |
|---|---|---|
| CA | 130989 | 2/2010 |
| CA | 134386 | 4/2011 |

(Continued)

OTHER PUBLICATIONS

Torcup, Inc., Hydraulic Bolting Tool Technology, Dec. 2005, Easton, Pennsylvania.

*Primary Examiner* — Hadi Shakeri

(74) *Attorney, Agent, or Firm* — Jerry Haynes Law

(57) ABSTRACT

A hollow shaped socket insert adapter rotatively driven by a single socket driver for tightening, loosing, and removing various sizes of nuts/bolts.

31 Claims, 19 Drawing Sheets

(56) References Cited

U.S. PATENT DOCUMENTS

| | | | |
|---|---|---|---|
| D624,796 | S | 10/2010 | Taylor |
| 8,327,739 | B2 | 12/2012 | Kubota |
| 8,459,152 | B2 | 6/2013 | Keong et al. |

FOREIGN PATENT DOCUMENTS

| | | |
|---|---|---|
| EP | 001607268-0001 | 4/2009 |
| EP | 001676941-0001 | 5/2010 |

* cited by examiner

SOCKET INSERT ADAPTER AND METHOD OF USE

CROSS REFERENCE TO RELATED APPLICATIONS

This application is a continuation application of U.S. Ser. No. 13/283,499, filed Oct. 27, 2011, entitled "Socket Insert Adapter and Method of Use", which is a continuation-in-part application of U.S. Ser. No. 12/434,609, entitled "Socket Insert Adapter", filed May 1, 2009, both applications incorporated herein for all purposes.

DESCRIPTION

Field of the Invention

The present invention in general relates to a socket insert. More particularly, it relates to a hollow shape socket insert adapter used in conjunction with a socket driver for tightening, loosening, removing various sizes of nuts and bolts.

Background of the Invention

Sockets are one of the most commonly used mechanical tools for driving nuts and bolts. Most of the earlier standard socket drivers were designed with specific metric or SAE size for fastening nuts/bolts thus each time a different socket driver was required for driving nuts/bolts of various dimensions and shapes. Some adjustable socket drivers having a movable jaw and a fixed jaw are available in the prior art to engage nuts/bolts of various dimensions and shapes but such socket drivers are not efficient to prevent rotation of nuts/bolts and do not offer grip to operate on different shapes and sizes of fasteners.

One of the common problem with inserts used in socket drivers of the prior art is the sharp corners which cause the spinning and slippage while providing torque to the inserts because of the improper locking between the insert and socket driver. The major drawback with existing split side, gap wall, and similar inserts available in the prior art is that they fail to provide the durability, strength, and efficiency for driving large diameter of nuts/bolts.

Thus, there is a longstanding need to design insert adapters which can be driven by a single socket driver efficiently to operate on a large range of nuts and bolts of different sizes and shapes.

SUMMARY OF THE INVENTION

Various embodiments have varying objectives. While various objectives are discussed below, not all embodiments will share all of the below objectives. In one embodiment, one objective may be to overcome the above mentioned disadvantages of the prior art by providing a hollow shaped socket insert adapter for tightening, loosening, and removing various sizes of nuts/bolts.

Another object of the present invention is to provide a plurality of hollow shaped socket insert adapters rotatively driven by a single socket driver for tightening, loosing, removing the various sizes of nuts/bolts.

Another objective of the present invention is to provide unique design inserts with rounded outside corners and rounded inside corners to maximize the torque on the flat wall of the insert.

Another objective of the present invention is to provide a relatively inexpensive hollow shaped socket insert adapter for tightening, loosing, removing the various sizes of nuts/bolts.

Another objective of the present invention is to provide a plurality of hollow shaped socket insert adapters of different sizes and different shapes with variable inner diameter specific to the size of the nuts/bolts to be driven.

The present invention has a further objective to hold the hollow shaped socket insert adapter securely inside the socket driver using a spring ball detent.

A further objective of the present invention is to provide an efficient, light weight, compact adjustable socket insert for socket drivers.

Yet another objective of the present invention is to provide a socket insert which can operate on interchangeable metric or SAE sizes using the same socket driver.

A further objective of the present invention is to provide a hollow shape socket insert adapter permitting the use of a wrench to drive a wrench socket.

Embodiments of the present invention provide a hollow shaped socket insert adapter rotatively driven by a single socket driver for tightening, loosing, removing the various sizes of nuts/bolts. A plurality of hollow shaped socket insert adapters with variable inner diameter has been provided to operate on smaller dimensions of nuts/bolts. The nuts/bolts have dimensions smaller with reference to the size of the socket driver cavity. Hollow shaped socket insert adapters of a single shape are capable of driving nuts/bolts of different sizes and shapes.

Some embodiments of the hollow shaped socket insert adapters are provided with rounded outside corners to avoid contacting inner corners of a socket driver and to maximize torque between outer walls of the adapter and inner walls of the socket driver. Some embodiments of the hollow shaped socket insert adapters are provided with rounded inner corners to avoid contact with corners of a nut/bolt to be driven and to maximize torque between inner walls of adapter and outer walls of the nut/bolt to be driven.

The hollow shaped socket insert adapter specific to the size of the subject nut/bolt to be driven is chosen and placed inside the socket driver cavity. Force is applied to the socket driver body enabling the hollow shape socket insert adapter to tighten, loosen, and remove the subject nut/bolt.

In some embodiments, a mechanical arrangement for electrically, hydraulically, or pneumatically tightening, loosening or removing nuts and bolts of various sizes is provided. The mechanical arrangement includes a socket driver configured to receive and to be rotatively driven by a torque force from at least one of electrical, hydraulic, or pneumatic means, wherein the torque force generated by the electrical, hydraulic or pneumatic means is greater than a torque force that can be applied manually by a human being; a plurality of hollow-shaped socket insert adapters that are configured to be rotatively driven by a the socket driver, and to receive the electrical, hydraulic, or pneumatic torque force via the socket driver, for tightening, loosening, or removing the nuts and bolts of various sizes, a given one hollow-shaped socket insert adapter of the plurality of hollow-shaped socket insert adapters. The hollow-shaped socket insert adapters include an inner configuration that has a shape and size to conform to and to fit on a head portion, having outside corners, of a given nut or bolt to be driven and wherein the shape of the inner configuration is a closed hollow shape. The mechanical arrangement also includes one or more inner flat walls and one or more rounded inner corners, the inner configuration being shaped to allow the one or more flat walls of the inner configuration to contact and engage, and the one or more rounded inner corners to avoid contacting and engaging, the outside corners of the head portion of the given nut or bolt to be driven; and the flat walls and rounded outer and inner corners increase the ability of the plurality of hollow-shaped socket insert adapters to receive the electrical, hydraulic, or pneumatic torque force via the socket driver and to transmit the torque force to the given nut or bolt to be driven.

In some embodiments, a method of driving nuts and bolts with a socket driver is provided. The method includes: selecting a nut or bolt to be driven; checking the size of the selected nut or bolt to be driven; selecting an appropriate socket insert adapter to fit the nut or bolt to be driven, wherein the socket insert adapter comprises rounded inner corners and rounded outer corners; placing the socket insert adapter inside a cavity of the socket driver; mating the socket insert adapter with the socket driver without contacting the rounded outer corners; mating the selected nut or bolt without contacting the inner rounded corners of the socket insert adapter; and applying torque to the socket driver to drive the selected nut or bolt.

BRIEF DESCRIPTION OF THE DRAWINGS

The disclosure will now be made, by way of example, with reference to the accompanying drawings, in which.

DETAILED DESCRIPTION OF THE INVENTION

Embodiments of the present invention provide a socket insert for tightening, loosening, and removing various nuts/bolts of smaller dimensions used in conjunction with a single socket driver. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description. Further multiple references to "one embodiment," "an embodiment" or "some embodiments" are often not referring to the same embodiments.

Embodiments of the present invention provide a hollow shaped socket insert adapter rotatively driven by a single socket driver for tightening, loosing, and removing the various sizes of nuts/bolts. A plurality of hollow shaped socket insert adapters with variable inner diameter has been provided to operate on smaller dimensions of nuts/bolts. Hollow shaped socket insert adapters of different shapes to rotatively drive nuts/bolts of different shapes have also been provided. Each of the hollow shaped socket insert adapters is provided with rounded outside corners and rounded inside corners to maximize the torque on the flat wall of the insert adapter when rotatively driven by a socket driver. The hollow shaped socket insert adapter specific to the size of the subject nut/bolt to be driven is chosen and placed inside the socket driver cavity. Force is applied to the socket driver body enabling the hollow shaped socket insert adapter to tighten, loosen, and remove the subject nut/bolt.

Figure 6A:
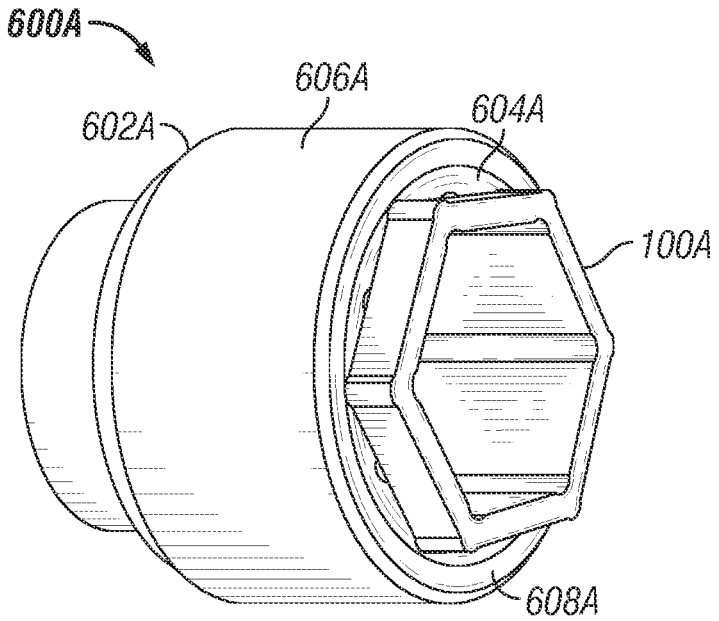
FIG. 6A is a perspective view of a 12 point socket driver with the hollow shaped Type 1 socket insert adapter of FIG. 1A conformed to the cavity of the socket driver, in accordance with an embodiment of the present invention.

Referring now to FIG. 6A, I present a perspective view of the hollow shaped Type 1 socket insert adapter 100A for use in conjunction with a 12 point socket driver, in accordance with an embodiment of the present invention.

Hollow shaped socket insert adapter 100A is a hollow insert that fits into the cavity of a socket driver. In an embodiment of the present invention, socket insert adapter 100A is composed of any metal to absorb heavy impact while being rotatively driven by a socket driver. In some embodiments, adapter 100A is composed of plastic, resin composites and polymers used in the aerospace industry that are very dense, strong, and tough. Examples of metal include, but are not limited to aluminum, steel and its alloys, brass, iron, titanium, and copper. In some embodiments, the adapter 100A is composed of steel or titanium for some high torque applications. In practice, titanium and steel alloys can be used at all torque levels of socket insert usage. Aluminum alloys have worked well at lower to mid-range torque applications, the difference being that some metals will have a longer life in industrial use. Aluminum inserts offer the light weight advantage in those applications where weight savings is critical, they may not last as long as the steel alloy composition inserts, but in some aerospace applications a light weight tool is of prime importance not its longevity. On the other hand, hydraulic wrenches with their very high torque operating ranges (>135,000 ft/lbs.), steel alloy composition inserts would be preferred. Aerospace applications will also be an industry where the composite or polymer socket inserts would be used.

The hollow shaped socket insert adapter may be of any shape formed of edges. Examples of shapes include a square, hexagonal, octagonal, decagonal, and dodecagonal, any polygonal or any special shape. Most industrial heavy use of nuts/bolt heads will be of the hexagonal design. This is because of the common design of heavy duty socket drivers are of the hexagonal variety. Simply a matter of economics that a standard was used globally to settle on hexagonal design for heavy duty use. Tools, wrenches, sockets were found to attach easier and more efficiently with the hex design. Also, hexagonal designs limit the damage to nut/bolt head corners upon torque applications because of the 120 degree angle of the corner faces themselves. Access to the hex design only requires 60 degrees of spatial area, whereas the square shape requires 90 degrees or triangle shapes required 120 degrees. In early industrial years square designs of nut/bolt heads were used, but when torque engaged at the four corners damage resulted at the corners resulting in rounded off nuts/bolts. More or less, a global standard was adopted for economic and design ease for hexagonal design. The common design of most impact sockets are of the hexagonal configuration, for example the very large 9½" SAE and 255 mm impact sockets are both of the hexagonal variety The socket insert adapter 100A is of varied sizes to accommodate the nuts/bolts of smaller dimensions with reference to the size of the socket driver. In an embodiment of the present invention, the sizes of the hollow shaped socket insert adapters are designed with different sizes, the sizes varying with a difference of at-least 1/16 inches (or about 1 mm). Most effective dimensions for the hollow shaped socket insert adapters vary from one inch (or 25 mm) to 12⅞ inch (or 327 mm). In an embodiment of the present invention, the socket insert adapter 100A has SAE (Society of Automotive Engineers) sizes. In another embodiment of the present invention, metric sizes corresponding to the SAE sizes are available. Further, hollow shaped socket insert adapters have interchangeable SAE to metric sizes or vice versa.

In an embodiment of the present invention, socket insert adapter 100A has an outer wall 102 and an inner wall 104 indicating that socket insert adapter 100A has a thickness 106. The thickness of the hollow shaped socket insert adapter is governed by the size of nuts/bolts to be driven. The outer wall of socket insert adapter 100A is structured to mechanically co-operate with the socket driver enabling it to conform to the cavity of the socket driver allowing it to tighten, loosen, and remove various smaller dimensions of nuts/bolts. The inner wall is configured to engage nuts/bolts of smaller dimensions and fits on the head portion of nuts/bolts.

Figure 1A:
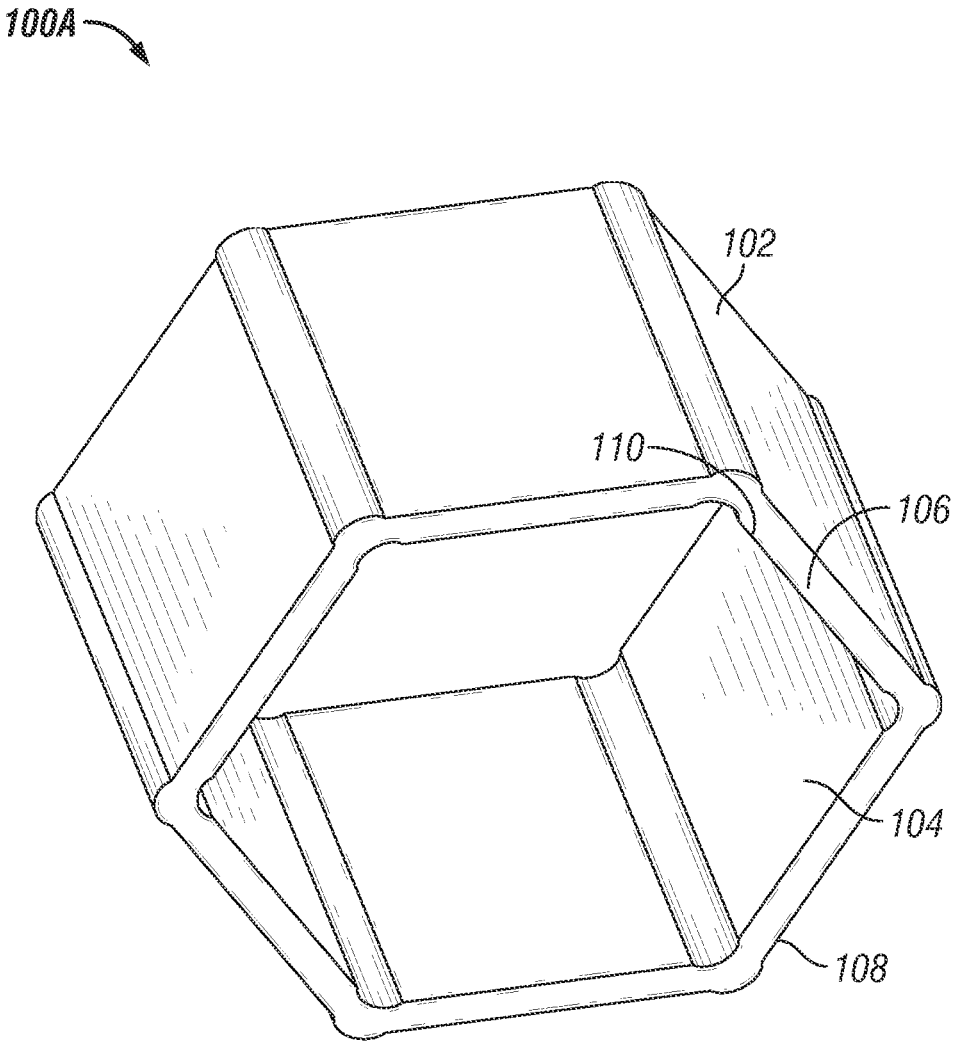
FIG. 1A is a perspective view of a hollow shaped Type 1 socket insert adapter for use in conjunction with the socket driver, in accordance with an embodiment of the present invention.
Figure 3A:
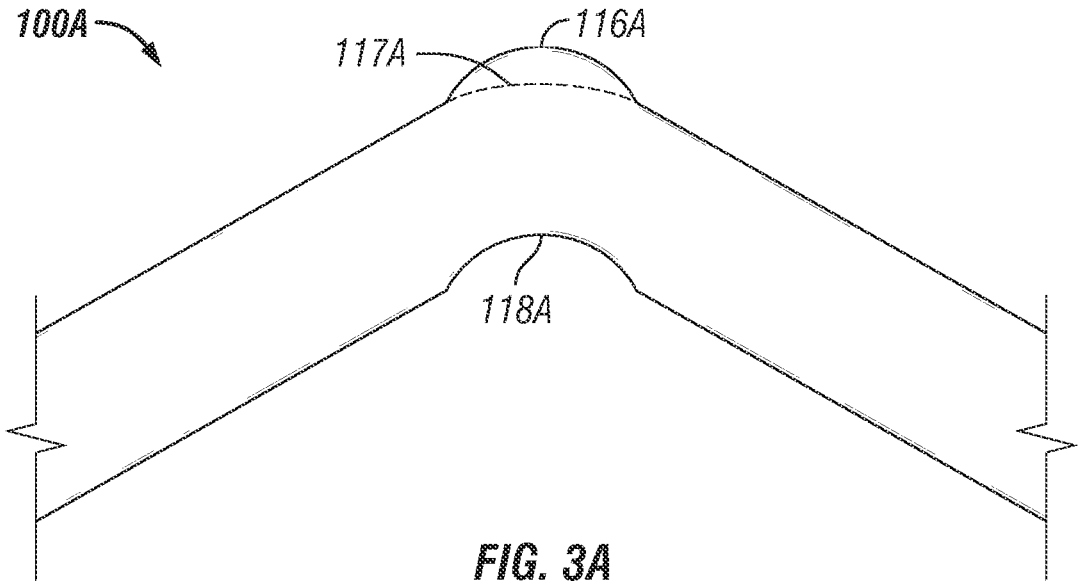
FIG. 3A is a magnified view of the corner of the hollow shaped Type 1 socket insert adapter of FIG. 1A for use in conjunction with the socket driver, in accordance with an embodiment of the present invention.
Figure 6B:
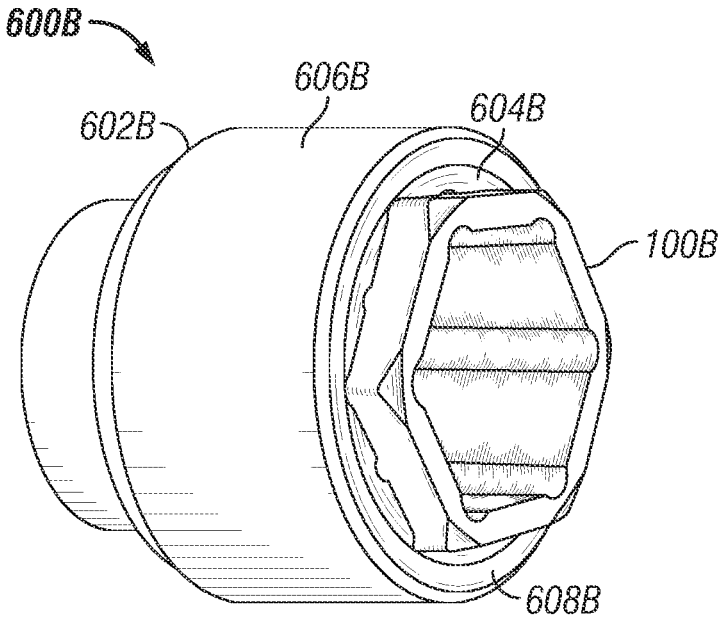
FIG. 6B is a perspective view of a 1 point socket driver with the hollow shaped Type 2 socket insert adapter of FIG. 1B conformed to the cavity of the socket driver, in accordance with an embodiment of the present invention.
Figure 6C:
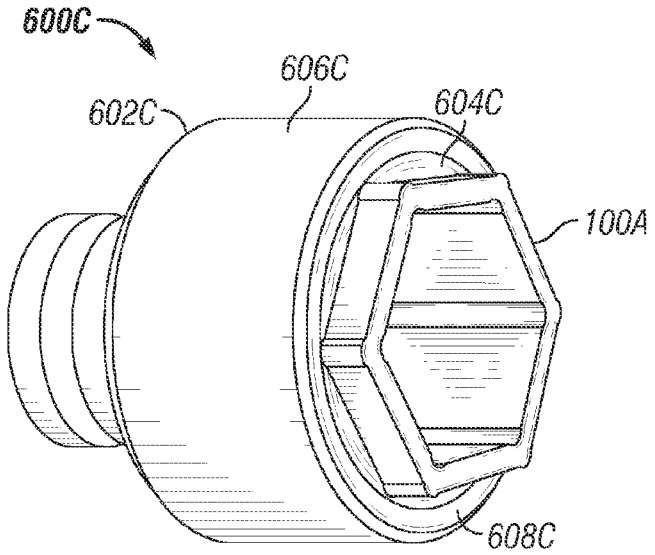
FIG. 6C is a perspective view of a hex socket driver with the hollow shaped Type 1 socket insert adapter of FIG. 1A conformed to the cavity of the socket driver, in accordance with an embodiment of the present invention.

Moving forward with reference to FIGS. 1A, 3A, and 6C, in one embodiment of the present invention, socket insert adapter 100A has an outer configuration 108 and an inner configuration 110. The outer configuration is designed to conform to the cavity 604C of a socket driver 600C. More specifically, in some embodiments, outer rounded corners 116A of adapter 100A are shaped to mate with a socket driver 600C with corresponding inner rounded corners. When the adapter 100A mates with the socket driver 600C, the outer rounded corners 116A of the socket insert 100A do not engage the inner rounded corners of the socket driver 600C. Instead, for higher torque, the outer flat walls 102 of the adapter 100A engage the inner flat walls 608C of the socket driver 600C. In these embodiments, higher torque is possible because greater torque may be applied through the flat inner walls 608C of the socket driver 600C to the outer walls 102 of the adapter 100A.

The inner configuration 110 interacts with the head portion of nuts/bolts (e.g., 199, FIGS. 1D, 12B) to be driven. More specifically, in some embodiments, inner rounded corners 118A are shaped not to engage corners of nuts/bolts to be driven. Instead, flat inner walls 104 of the adapter 100A engage flat walls of the nuts/bolts to be driven. In these embodiments, higher torque is possible because higher torque may be applied through the flat inner walls 104 of the adapter 100A to the outer walls of the nuts/bolts to be driven.

Depending on the particular embodiment, the construction of the outer configuration may or may not be similar to the construction of the inner configuration. For example, the outer configuration of the hollow shaped socket insert adapter may be selected from, but not limited to, a circle, square, pentagonal, hexagonal, decagonal, dodecagonal, and any polygonal and the inner configuration of the hollow shape socket insert adapter may be selected from, but not limited to, a circle, square, pentagonal, hexagonal, decagonal, dodecagonal, and any polygonal, indicating that the hollow shape socket insert adapter that are 6 pt. (hexagonal) on the outside can be 4 pt, 5 pt, 6 pt, 7 pt, 8 pt., 10 pt, 12 pt., SAE or metric dimension on the "inside" of the hollow shaped socket insert adapter. This enables the single socket driver to operate on nuts/bolts of different shapes and smaller dimensions effectively. In an embodiment of the present invention, various SAE to SAE; SAE to metric; metric to metric; metric to SAE; 6 pt. to 6 pt.; 6 pt. to 8 pt.; 6 pt. to 12 pt.; 12 pt. to 12 pt.; 12 pt. to 8 pt.; 12 pt. to 6 pt. combinations are possible. The exercise of different hollow shaped socket insert adapters enables a great variety of socket driver dimensions and configurations. For example: if one has a 3" SAE hexagonal (6 pt.) socket driver, this socket driver can now become a platform for tightening, loosening, and removing nuts/bolts of different configurations having dimensions smaller than 3". The combination of outer configurations 108 and inner configurations 110 vary in great variety.

In an embodiment of the present invention, the outer configuration 108 of the hollow shaped socket insert adapter is similar to the cavity of socket driver to fit well to the cavity of the socket driver. In another embodiment of the present invention, outer configuration 108 of the hollow shaped socket insert adapter is not similar to the cavity of socket driver.

In the embodiment of FIG. 1A, the hollow shaped adapter 100A is six sided—hexagonal. In some embodiments, hexagonal adapter 100A is used in conjunction with a 6 point socket driver. In some other embodiments, an adapter may have 4 sides for use with a 4 point socket driver, 8 sides for use with an 8 point socket driver, or some other number of sides for use with a socket driver with a corresponding number of points. In some embodiments, when the adapter has the same number of outer sides as the socket driver has inner sides, then the flat outer walls of the socket driver engage flat walls of the adapter engage flat inner walls of the socket driver. These embodiments may therefore be used in higher torque applications.

Figure 1B:
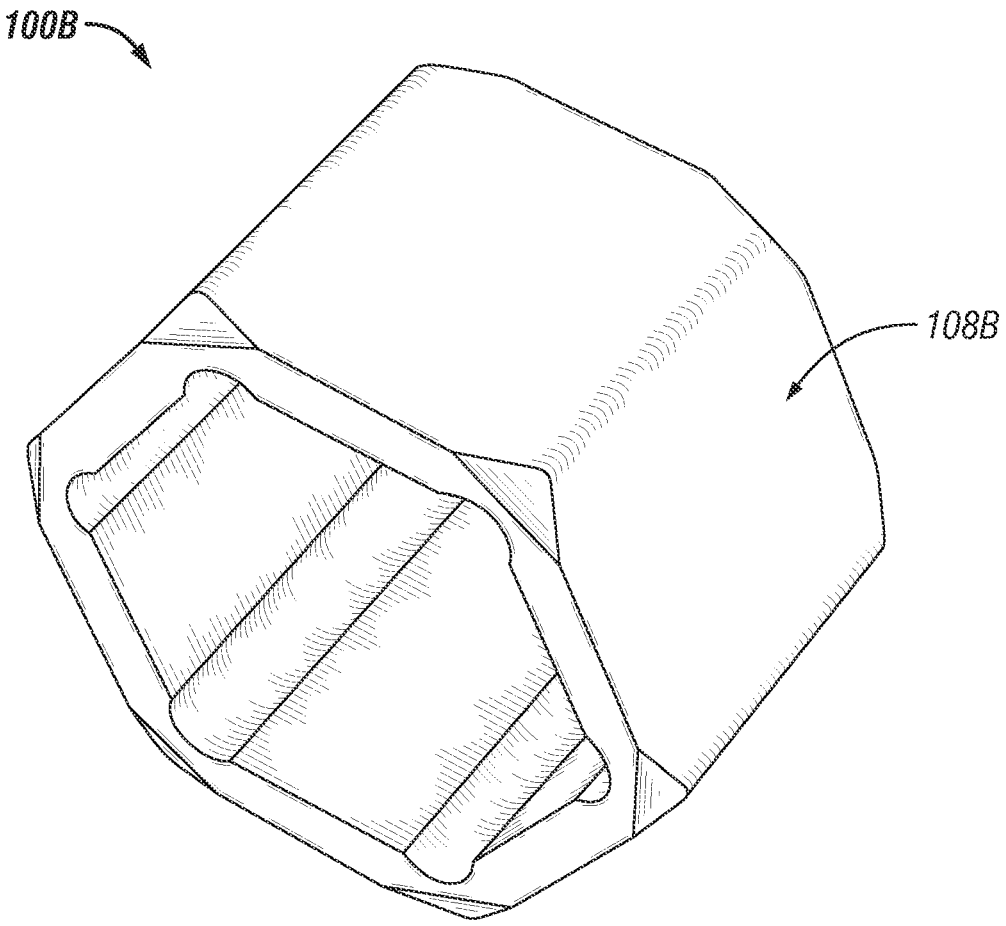
FIG. 1B is a perspective view of a hollow shaped Type 2 socket insert adapter for use in conjunction with the socket driver, in accordance with an embodiment of the present invention.

FIG. 1B is a perspective view of the hollow shaped Type 2 socket insert adapter 100B for use in conjunction with a 12 point socket driver, in accordance with an embodiment of the present invention, the advantage of which will be hereinafter described.

Figure 1C:
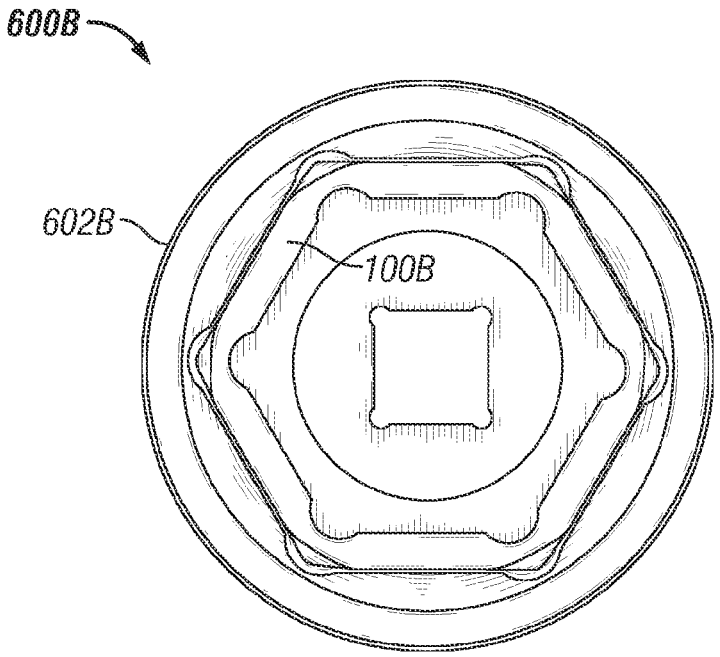
FIG. 1C is the Type 2 socket insert adapter of FIG. 1B mated with a socket.
Figure 1D:
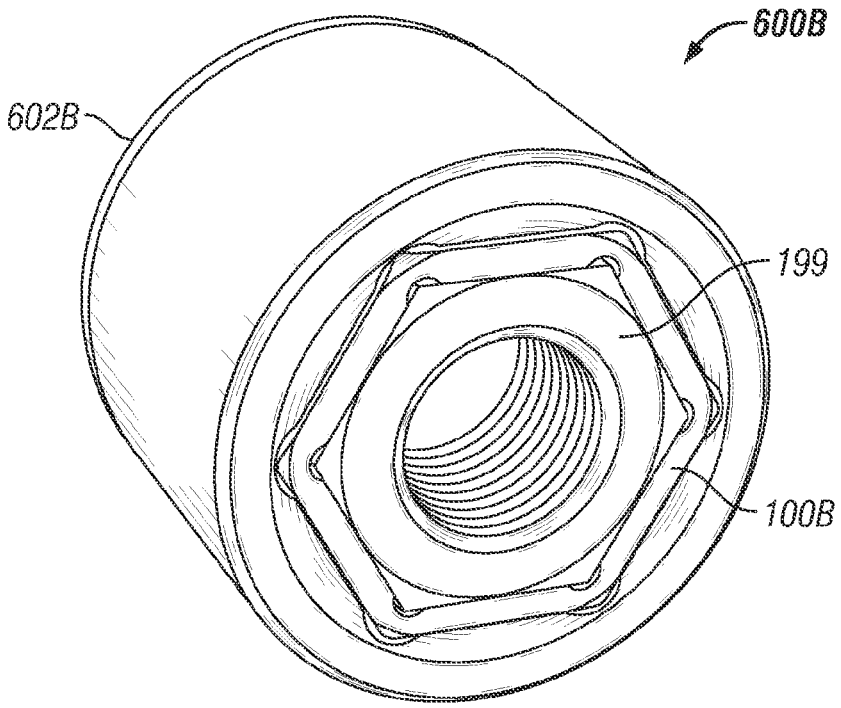
FIG. 1D is the Type 2 socket insert adapter of FIG. 1B mated with the socket and a nut to be driven.
Figure 1E:
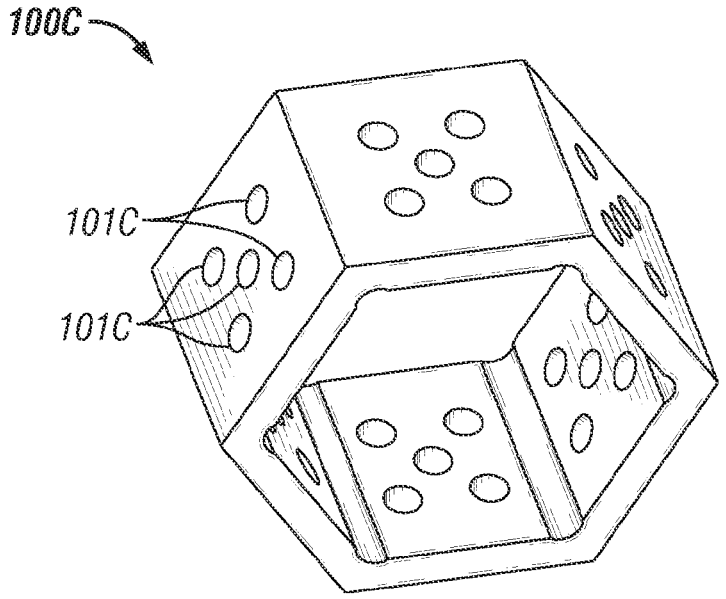
FIG. 1E is a perspective view of a hollow shaped Type 3 socket insert adapter for use in conjunction with the socket driver, in accordance with an embodiment of the present invention.

FIG. 1E is a perspective view of the hollow shaped Type 3 socket insert adapter 100C for use in conjunction with a 12 point socket driver, in accordance with an embodiment of the present invention. In some embodiments, weight of the socket insert adapter is a critical limiting factor. Thus, holes 101C are drilled in the outer walls of a Type 2 insert adapter to produce a Type 3 socket insert adapter 100C having less weight yet still provide structural integrity of a Type 1 socket insert adapter to withstand substantial torque forces.

Figure 2:
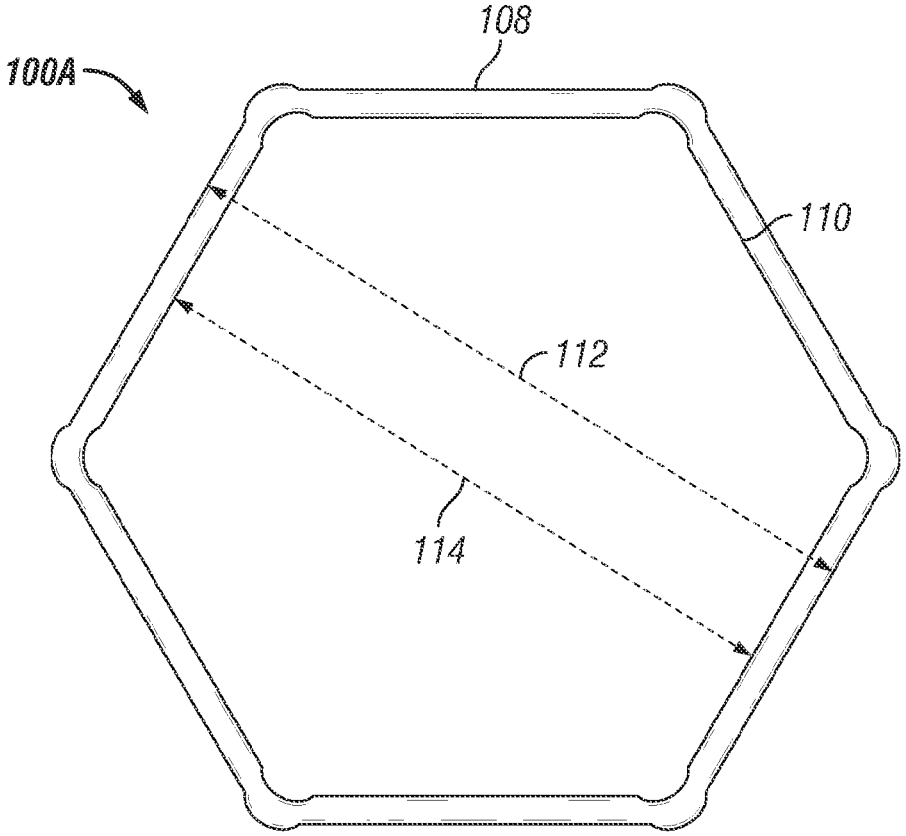
FIG. 2 is a top view of the hollow shaped socket insert adapter of FIG. 1A for use in conjunction with the socket driver, in accordance with an embodiment of the present invention.

FIG. 2 is a top view of hollow shaped socket insert adapter 100A of FIG. 1 for use in conjunction with the socket driver, in accordance with an embodiment of the present invention.

In an embodiment of the present invention, socket insert adapter 100A has an outer diameter 112 to fit inside the socket driver cavity and a variable inner diameter 114 to operate on large range of smaller sizes of nuts/bolts. The variable inner diameter 114 of the hollow shaped socket insert adapter conforms to the head portion of nuts/bolts of different sizes. The hollow shaped socket insert adapter has rounded corners. Details corresponding to the rounded corners have been provided in conjunction with FIG. 3.

FIG. 3A is a magnified view of the corner of hollow shaped Type 1 socket insert adapter 100A of FIG. 1A for use in conjunction with a 12 point socket driver, in accordance with an embodiment of the present invention.

The socket insert adapter 100A is designed to have rounded "outside" corners 116A and rounded "inside" corners 118A which enables concentrating more torque upon the flat walls 102, 104 of the hollow shape insert rather than at corners. This helps to reduce the possibility of "rounded" corners upon the nut or bolt head portion being tightened or loosen. The rounded "outside" corners 116A and rounded "inside" corners 118A of the hollow shape socket insert adapter 100A securely holds socket insert adapter 100A inside the socket driver cavity (e.g., 604C) and prevents it from spinning and slippage.

In the embodiment shown in FIG. 3A, the rounded outer corners 116A protrude slightly. In other embodiments, the rounded outer corners do not protrude, but are rounded without protruding (See e.g., rounded "outside corner 117A (FIG. 3A, in phantom)). The embodiment with the nonprotruding outer rounded corners may be used with a standard socket driver without any rounded inner corners.

Figure 3B:
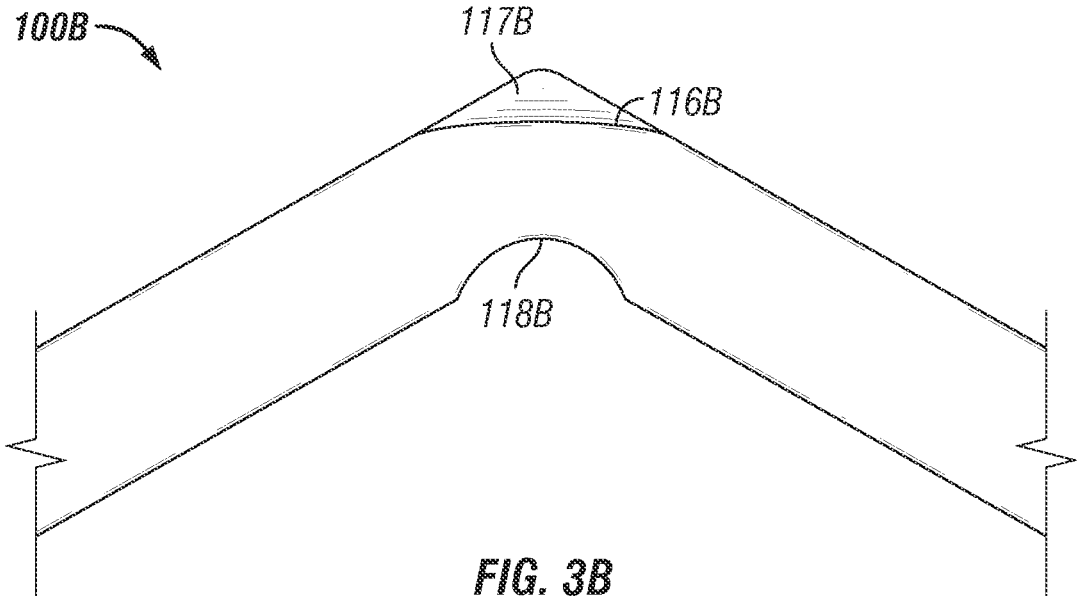
FIG. 3B is a magnified view of the corner of the hollow shaped Type 2 socket insert adapter of FIG. 1B for use in conjunction with the socket driver, in accordance with an embodiment of the present invention

Referring now to FIGS. 1B, 3B, and 6B, a hollow shaped Type 2 socket insert adapter 100B for use in conjunction with the 12 point socket driver 600B, in accordance with an embodiment of the present invention is depicted. The Type 2 embodiment, with all flat intersecting planes on the exterior faces, accommodates socket wrench designs having similar arrangement of faces at their interior. The socket insert adapter 100B is designed to have smooth "outside" corners 116B and rounded "inside" corners 118B which enables concentrating more torque upon the flat walls of the hollow shape insert rather than at corners.

Figure 4A:
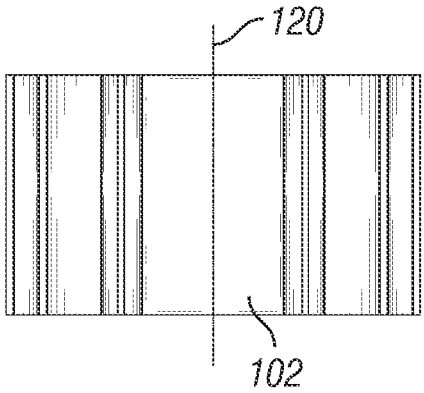
FIG. 4A is a cross sectional view of the hollow shaped Type 1 socket insert adapter of FIG. 1A taken along the wall, for use in conjunction with the socket driver, in accordance with an embodiment of the present invention.
Figure 4B:
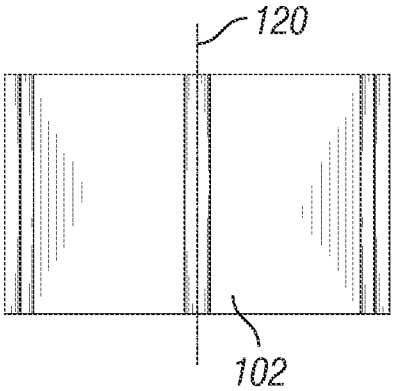
FIG. 4B is a cross sectional view of the hollow shaped Type 1 socket insert adapter of FIG. 1A taken along the corners, for use in conjunction with the socket driver, in accordance with an embodiment of the present invention.

Referring now to FIG. 4A and FIG. 4B, I present a cross sectional view of the hollow shape socket insert adapter 100A of FIG. 1A taken along the wall and along the corners respectively, for use in conjunction with the socket driver, in accordance with an embodiment of the present invention.

The hollow shaped socket insert adapter has outer wall 102 concentric about longitudinal axis 120 configured to conform to the cavity of the socket driver. Socket insert adapter 100A is configured to slidably and non-rotatably engage a nut/bolt to be driven.

Figure 5A:
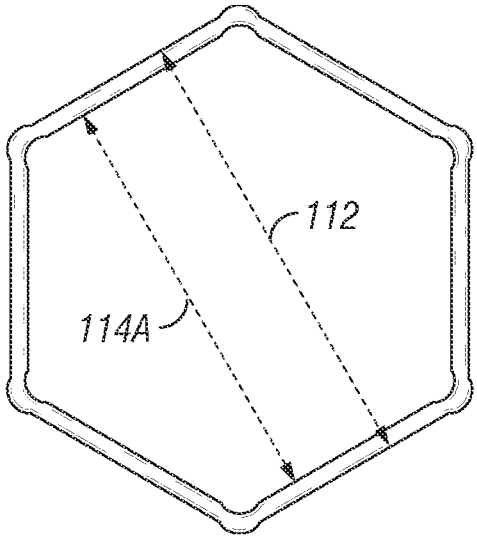
FIG. 5A is a top view of the hollow shaped Type 1 socket insert adapter of FIG. 1A, for use in conjunction with the socket driver, in accordance with an embodiment of the present invention.
Figure 5B:
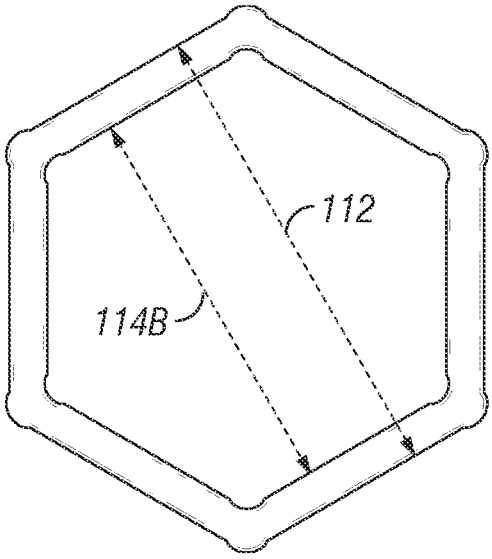
FIG. 5B is a top view of the hollow shaped Type 1 socket insert adapter of FIG. 1A, for use in conjunction with the socket driver, in accordance with another embodiment of the present invention.

FIG. 5A and FIG. 5B are top views of a hollow shaped socket insert adapter 100A of FIG. 1A, for use in conjunction with the socket driver, in accordance with an embodiment of the present invention.

Both FIG. 5A and FIG. 5B present socket insert adapter 100A showing an outer diameter 112 to fit inside the socket driver cavity and an inner diameter 114*a* and 114*b* which is different for each case. The variable inner diameter is achieved by varying (increasing or decreasing) thickness 106 of the hollow shaped socket insert adapters. In an embodiment of the present invention, increasing the thickness of the hollow shaped socket insert adapter decreases the inner diameter of the hollow shape socket insert adapter. The varying inner diameter enables the hollow shaped socket insert adapter to tighten, remove, and loosen various nuts/bolts of smaller dimensions.

FIG. 6A is a perspective view of socket driver 600A with a hollow shaped Type 1 socket insert adapter 100A of FIG. 1A conformed to the cavity 604A of a 12 point socket driver, in accordance with an embodiment of the present invention. FIG. 6C is a perspective view of socket driver 600C with hollow shaped Type 1 socket insert adapter 100A of FIG. 1A conformed to the cavity 604C of a hex socket driver, in accordance with an embodiment of the present invention.

Socket drivers 600A (12 point) and 600C (hex) have socket driver bodies 602A and 602C, respectively enclosing a socket driver cavities 604A and 604C. Outer walls 606A and 606C of the socket drivers and inner walls 608A and 608C of the socket drivers define the structure of the socket drivers. Socket driver cavities 604A and 604C accommodate the hollow shaped socket insert adapters. Outer walls 602A and 602C of socket insert adapter 100A interacts with inner walls 608A and 608C of the socket drivers for rotatively driving nuts/bolts of smaller dimensions Inner wall 104 of socket insert adapter 100A is configured to engage nuts/bolts of smaller dimensions and fits on the head portion of nuts/bolts. In some embodiments, adapters 100A, 100B, and 100C remain below the rim of inner walls 608A and 608C, most preferably about 1/16" below the rim. This ensures that the inner wall rim will not interfere with the application of maximum torque for tightening and loosening actions.

FIG. 6B is a perspective view of a 12 point socket driver 600B with a hollow shaped Type 2 socket insert adapter 100B of FIG. 1B conformed to the cavity 604B of a 12 point socket driver, in accordance with an embodiment of the present invention. Outer walls 606B of the socket driver and inner walls 608B of the socket driver define the structure of the socket driver. Socket driver cavitiy 604B accommodates the hollow shaped socket insert adapter. Outer wall 108B of socket insert adapter 100B interacts with inner walls 608B of the socket drivers for rotatively driving nuts/bolts of smaller dimensions Inner walls 604B of socket insert adapter 100B is configured to engage nuts/bolts of smaller dimensions and fits on the head portion of nuts/bolts.

The Type 2 design has the advantage of enabling a socket insert to fit into socket drivers that have only straight wall interiors, that is, it will fit into the sockets that have only flat walls (without the inner corner concave radii at the inner face intersections) as well as the newer type of socket drivers that have the inner corner concave radii (FIGS. 1C & 1D). Type 2 design fits also in the 12 pt. sockets. A Type 1 insert design will not fit into the "older" design of socket drivers because of the presence of the outside corner radii. Another advantage of the Type 2 design is that it has a chamfer at top and bottom of outside intersecting faces. The chamfer allows for easier insertion and extraction from socket drivers and open and closed end wrenches. The chamfer feature helps guide the socket insert into the accommodating socket driver especially where the tool is used in less than ideal conditions environmentally.

Figure 6D:
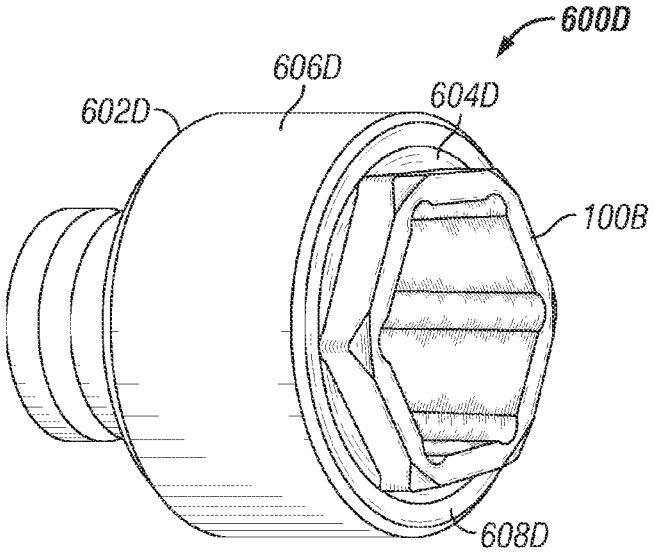
FIG. 6D is a perspective view of a hex socket driver with the hollow shaped Type 2 socket insert adapter of FIG. 1B conformed to the cavity of the socket driver, in accordance with an embodiment of the present invention.

FIG. 6D is a perspective view of a hex socket driver 600D, comprising socket driver body 602D, outer walls 606D and inner walls 608D with hollow shaped Type 2 socket insert adapter 100B of FIG. 1B conformed to the cavity 604D of a hex socket driver, in accordance with an embodiment of the present invention.

Figure 6E:
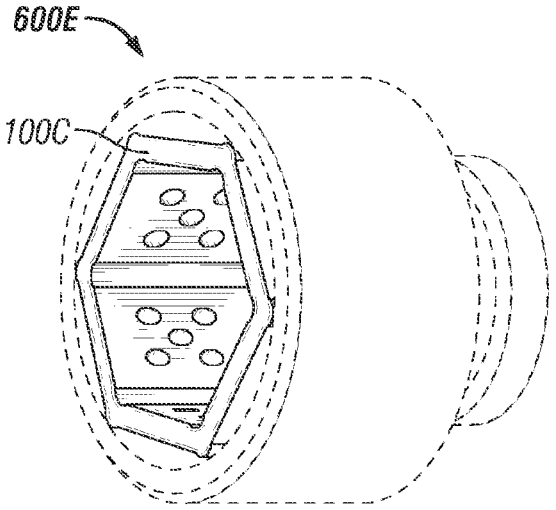
FIG. 6E is a perspective view of a hex socket driver (in phantom) with the hollow shaped Type 3 socket insert adapter of FIG. 1E conformed to the cavity of the socket driver, in accordance with an embodiment of the present invention.

FIG. 6E is a perspective view of a 6 point socket driver 600E (in phantom) for use with a hollow shaped Type 3 socket insert adapter 100C of FIG. 1E.

Figure 7A:
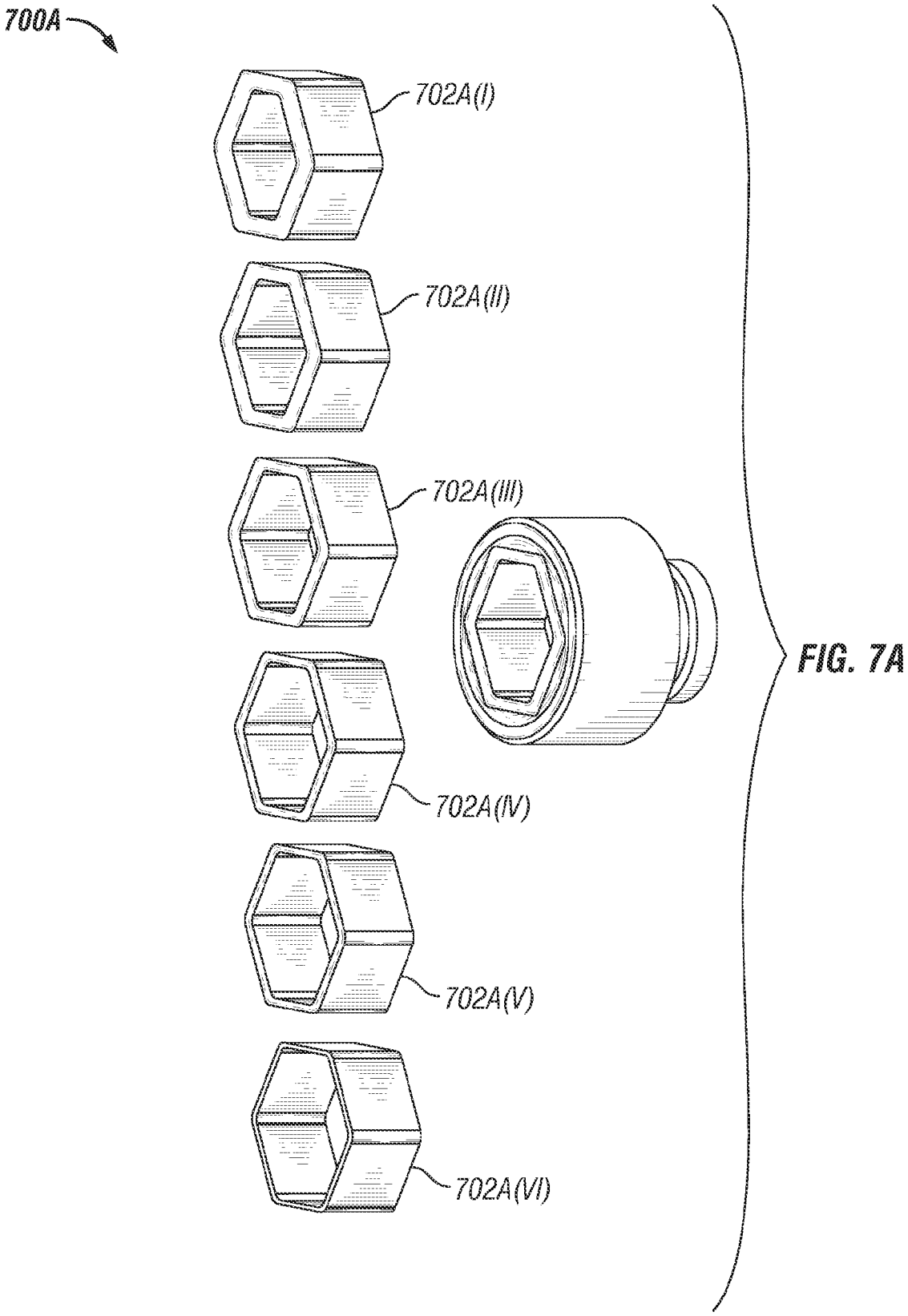
FIG. 7A is an illustrative view of the plurality of the hollow shaped Type 1 socket insert adapters of FIG. 1A with variable inner diameter for use in conjunction with a single 6 point socket driver, in accordance with an embodiment of the present invention.

FIG. 7A is an illustrative view of the plurality of hollow shaped Type 1 socket insert adapters 700A of FIG. 1A with variable inner diameter to use in conjunction with single socket driver, in accordance with an embodiment of the present invention.

The hollow shaped socket insert adapters 702A(i), 702A(ii), 702A(iii), 702A(iv), 702A(v), and 702A(vi) have a fixed outer diameter 112 and a different inner diameter 114. The sizes of the hollow shape socket insert adapters vary with a difference of at-least 1/16 inches (or about 1 mm). The varying inner diameter 114 enables the hollow shape socket insert adapters to fit on different smaller dimensions of nuts/bolts. Thus, one socket driver is enabled to be used to tighten, loosen, and remove nuts/bolts of different sizes and shapes.

Figure 7B:
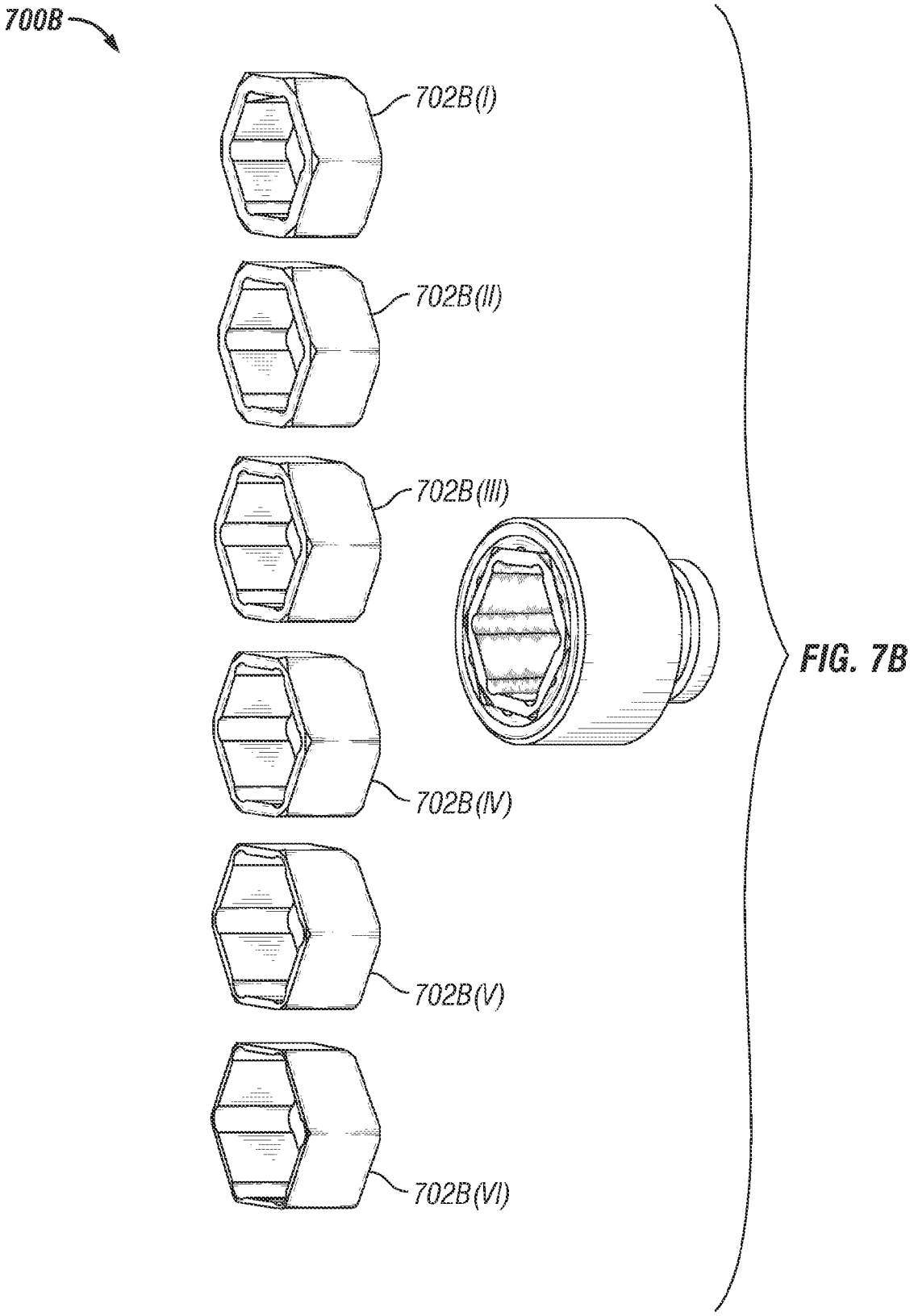
FIG. 7B is an illustrative view of the plurality of the hollow shaped Type 2 socket insert adapters of FIG. 1B with variable inner diameter for use in conjunction with a single 12 point socket driver, in accordance with an embodiment of the present invention.

FIG. 7B is an illustrative view of the plurality of hollow shaped Type 2 socket insert adapters 700B of FIG. 1B with variable inner diameter to use in conjunction with single socket driver, in accordance with an embodiment of the present invention.

Figure 8:
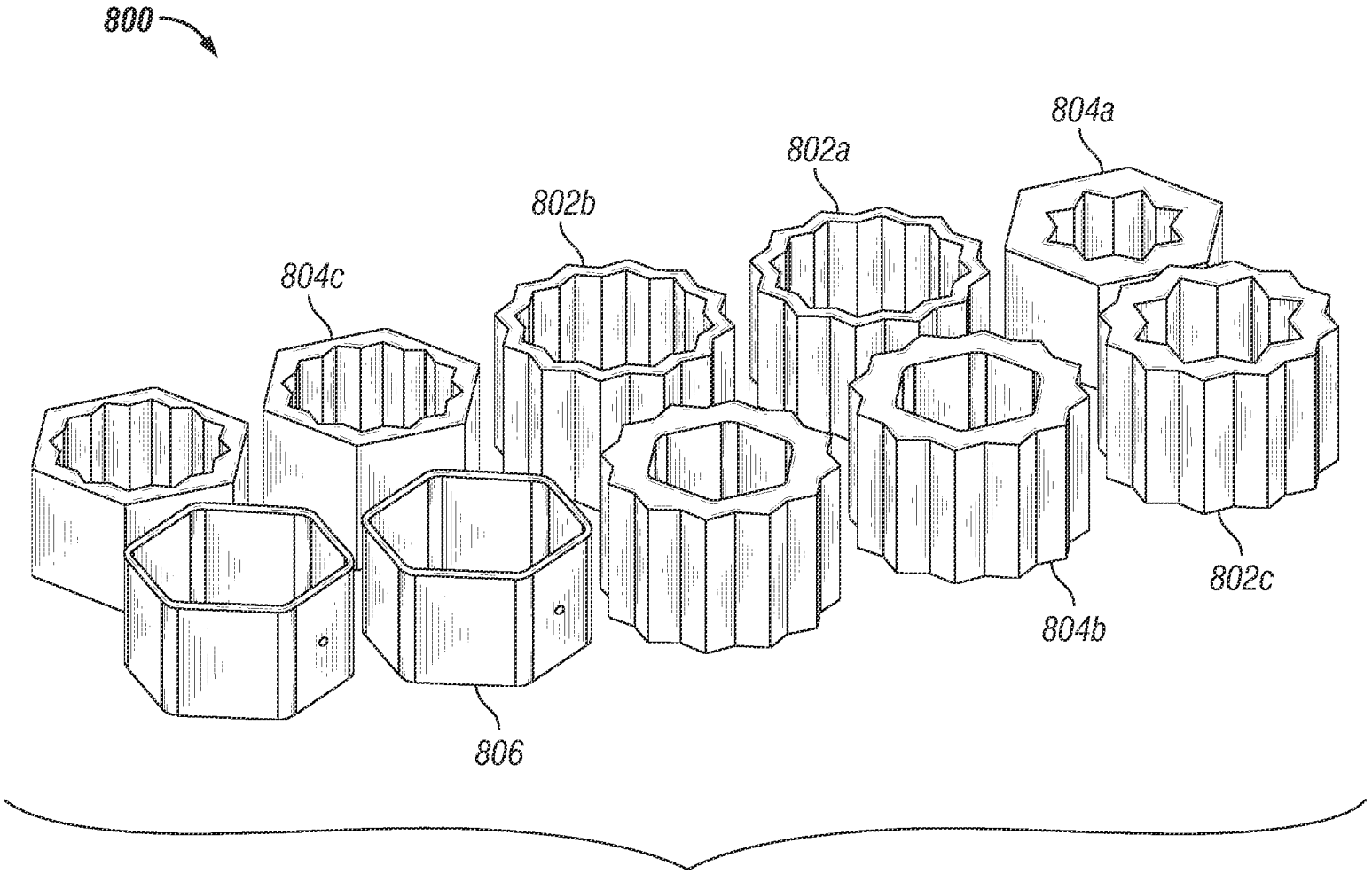
FIG. 8 is an exemplary view of a plurality of the hollow shaped socket insert adapters of different shapes and different sizes for use in conjunction with the socket diver, in accordance with an embodiment of the present invention.

FIG. 8 is an exemplary view of a plurality of hollow shaped socket insert adapters 800 of different shapes and different sizes for use in conjunction with the socket driver, in accordance with an embodiment of the present invention.

In an embodiment of the present invention, the hollow shaped socket insert adapter has a fixed outer diameter 112 and a variable inner diameter 114. The variable inner diameter 114 of the hollow shape socket insert adapter conforms to the head portion of nuts/bolts of different sizes. Inserts 802*a*, 802*b*, 802*c* are examples of inserts having a fixed outer diameter and a variable inner diameter.

In another embodiment of the present invention, the hollow shaped socket insert adapter has an outer configuration 108 and an inner configuration 110. The construction of the outer configuration may or may not be similar to the construction of the inner configuration. For example: the outer configuration of the hollow shaped socket insert adapter may be selected from, but not limited to, a circle, square, pentagonal, hexagonal, decagonal, dodecagonal, and any polygonal and the inner configuration of the hollow shape socket insert adapter may be selected from, but not limited to, a circle, square, pentagonal, hexagonal, decagonal, dodecagonal, and any polygonal. The combination of outer configurations 108 and inner configurations 110 vary in great variety. Thus, by means of a series of hollow shaped socket insert adapters, single socket driver is employed to operate upon a large number of nuts/bolts of different size and shapes. Inserts 804*a*, 804*b*, 804*c* are examples of inserts with different inner and outer configuration.

In another embodiment of the present invention, the hollow shaped socket insert adapters are adapted to be used with spring ball detent. Details corresponding to inserts for spring ball detent have been provided in conjunction with FIG. 9. Insert 806 is adapted to be used with spring ball detent.

Figure 9:
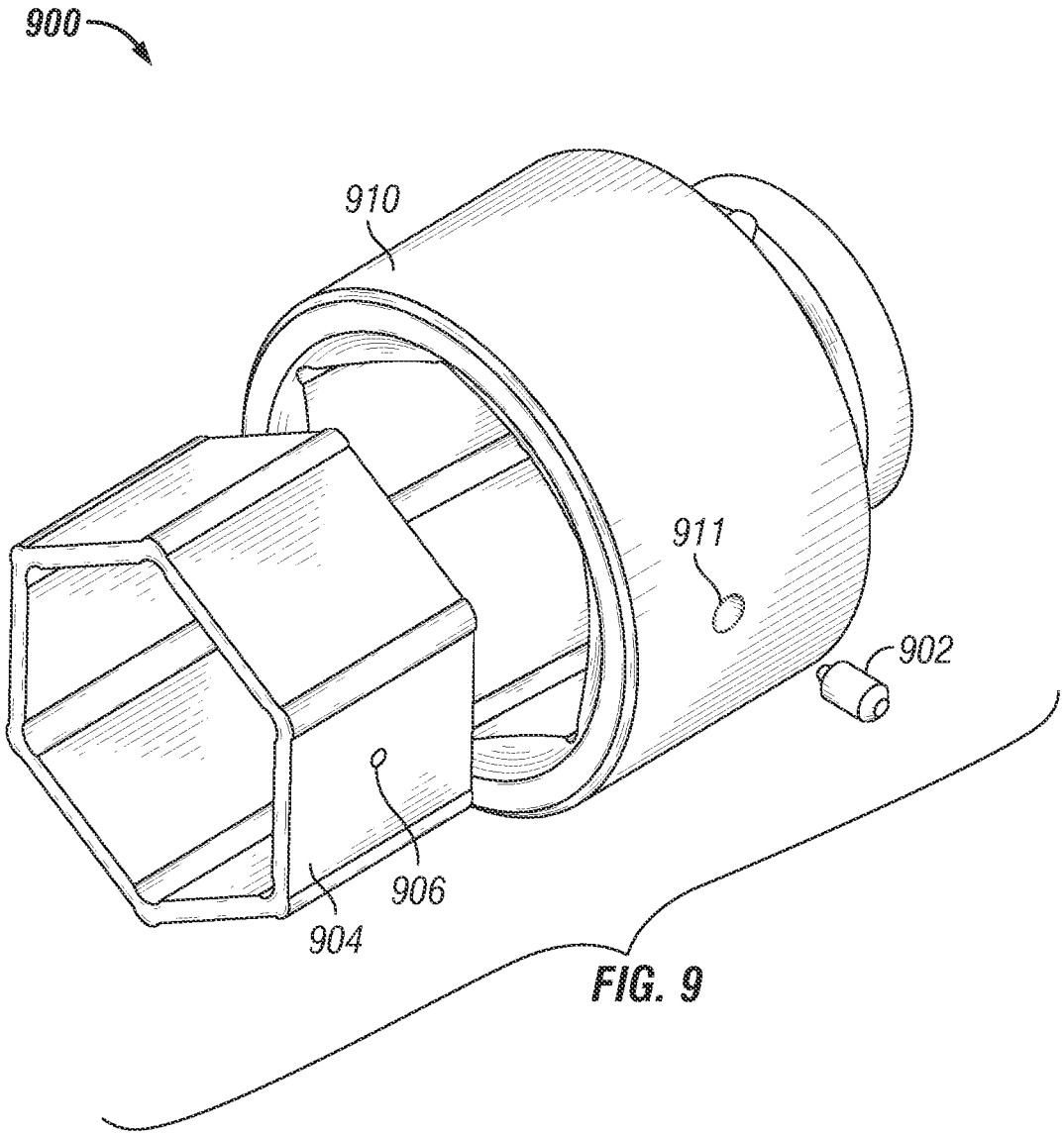
FIG. 9 is a perspective view of the hollow shaped socket insert adapter and socket driver with provision for spring ball detent, for use in conjunction with the socket driver, in accordance with another embodiment of the present invention.

FIG. 9 is a perspective view of the hollow shaped socket insert adapter with provision for spring ball detent 902, for use in conjunction with the socket driver, in accordance with another embodiment of the present invention. Preferably, spring ball detent 902 can be added to socket driver 910 in manufacture, or afterwards as a modification.

Spring ball detent 902 is a simple mechanical arrangement used to hold hollow shape socket insert 904 securely within socket driver 910 while operating upon nuts/bolts. The spring ball is a single, usually metal sphere, sliding within a bored cylinder, against the pressure of a spring, which pushes the ball against the hollow shaped socket insert adapter, which carries hole 906. Spring ball detent 902 passes through hole 911 (in the socket driver body) and hole 906 (in the hollow socket insert) to hold the hollow socket insert in place while rotatively driving the nuts/bolts of different shapes and sizes. Preferably, spring ball detent 902 is affixed permanently to the socket driver cavity wall.

In another embodiment of the present invention, the hollow socket insert is held securely in place using a magnetic metal for production of hollow socket insert. In another embodiment of the present invention, the hollow socket insert is held in place using pins.

Further referencing FIG. 9, in some embodiments, socket driver 910 includes a plurality of flat inner walls. The flat inner walls intersect to define a plurality of rounded inner corners. Collectively, the plurality of rounded inner corners and the plurality of flat inner walls define a chamber for receiving hollow socket insert 904.

In some embodiments, hollow socket insert 904 includes outer flat walls. At intersections of the flat outer walls, hollow socket insert 904 defines one or more outer rounded corners. The outer flat walls and the outer rounded corners of hollow socket insert 904 define an outer configuration having a shape and size to conform to and to fit into the cavity of socket driver 910. The outer configuration of socket insert 904 is shaped to allow the plurality of outer flat walls of the outer configuration to contact and to engage, and the one or more outer corners to avoid engaging, the chamber of socket driver 910. That is, the plurality of flat outer walls of the socket insert contact and engage the plurality of flat inner walls of the chamber of socket driver 910. Further, the rounded outer corners of socket adapter 904 do not contact or engage the rounded inner corners of the chamber of socket driver 910.

Figure 10:
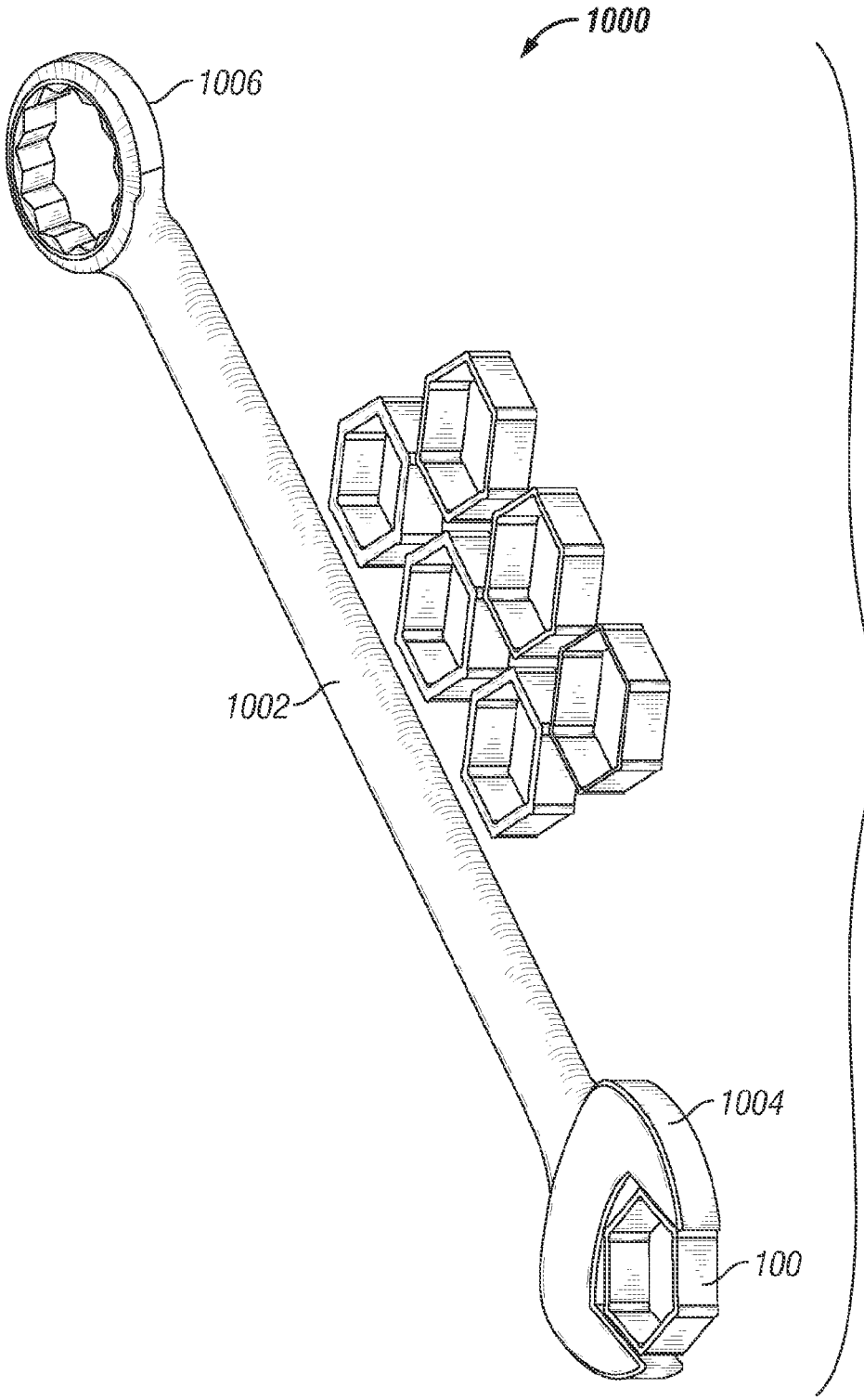
FIG. 10 is a perspective view of an additional embodiment of the invention showing the arrangement wherein the hollow shaped socket insert adapter is adapted to be employed along with the socket wrench to operate on nuts/bolts, in accordance with another embodiment of the present invention.

FIG. 10 is a perspective view of an additional embodiment of the invention 1000 showing the arrangement wherein the hollow shape socket insert adapter is adapted to be employed along with the socket wrench to operate on nuts/bolts, in accordance with another embodiment of the present invention.

Socket wrench 1002 is a type of tightening tool used to tighten, loosen, and remove nuts/bolts. In an embodiment of the present invention, socket wrench is an open end socket wrench 1004. In another embodiment of the present invention, socket wrench is a closed box end wrench 1006. The socket wrench is enabled to use socket insert adapter 100A, 100B, or 100C for tightening, loosening, and removing nuts/bolts of different dimensions by receiving socket insert adapters 100A, 100B, or 100C in the cavity at its end.

Figure 11:
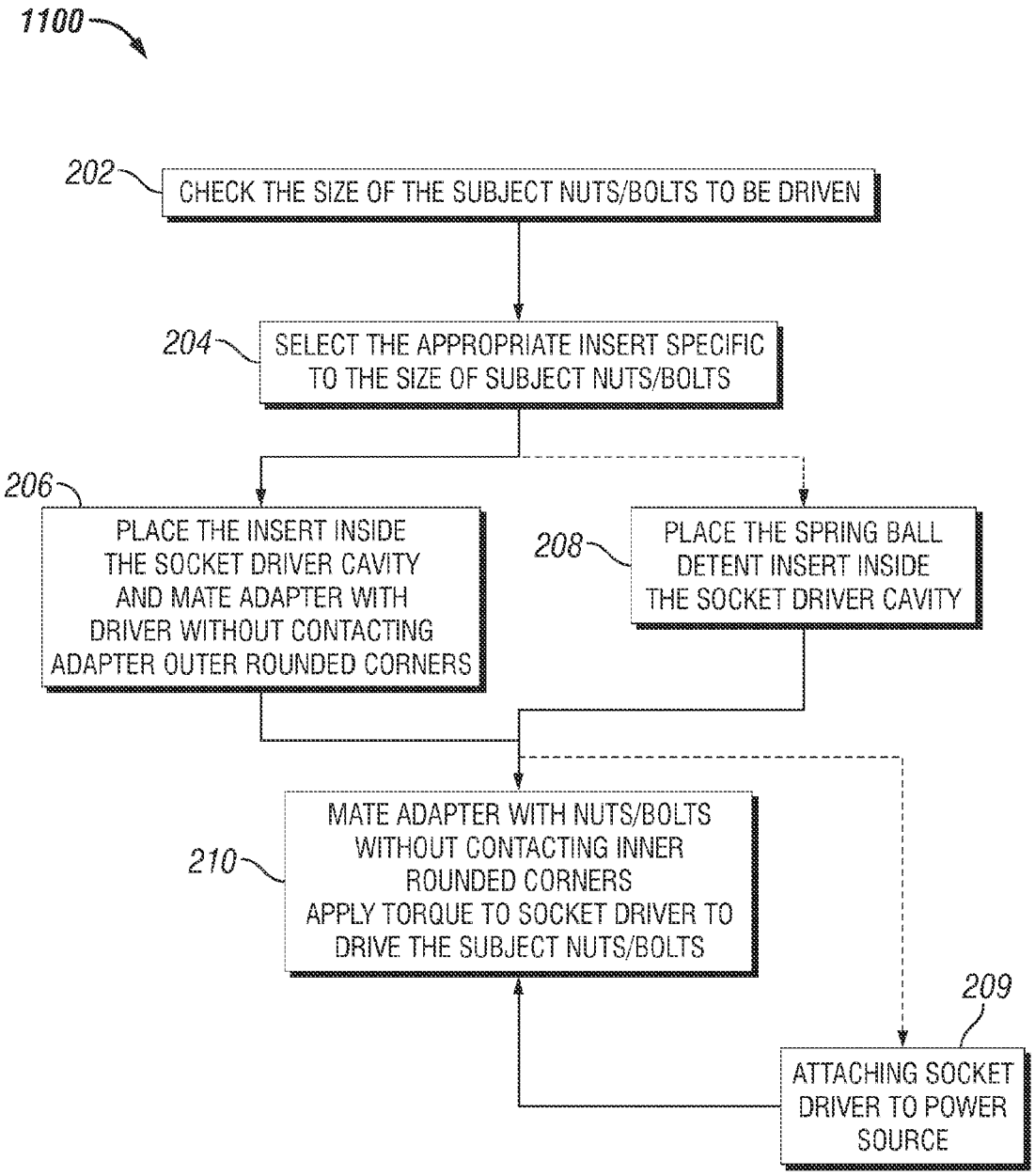
FIG. 11 is a method flow diagram depicting the practice and use of the hollow shaped socket insert adapter, in accordance with an embodiment of the present invention.

Referring now to FIG. 11, I present a block diagram 1100 depicting the practice and use of the hollow shaped socket insert adapter, in accordance with an embodiment of the present invention.

At step 202, the dimension and shape of the nut/bolt to be driven, are checked. At step 204 an appropriate hollow shaped socket insert adapter specific to the size of subject nut or bolt head dimension is selected. At step 206, the hollow shaped socket insert adapter is placed inside the socket driver cavity. Further referencing step 206, in some embodiments, an insert is placed inside a socket driver cavity and adapter is mated with driver without contacting outer rounded corners. As discussed above, not all embodiments have outer rounded corners. In another embodiment of the present invention, hollow socket insert having a spring ball detent provision is placed within the socket driver/socket wrench cavity at step 208. Socket driver/socket wrench with hollow shaped socket insert adapter is now ready for application of torque to tighten, loosen, or remove the subject nut or bolt. In another embodiment, at step 209 the socket driver may be optionally attached to a power source, preferably including electrical, hydraulic, and pneumatic impact wrenches. At step 210, torque force is applied on the socket driver/socket wrench. The torque force may be applied by manual, electric, hydraulic, or pneumatic means. Further referencing step 210, in some embodiments, adapter is mated with nuts/bolts without contacting inner rounded corners of the adapter.

Figure 12A:
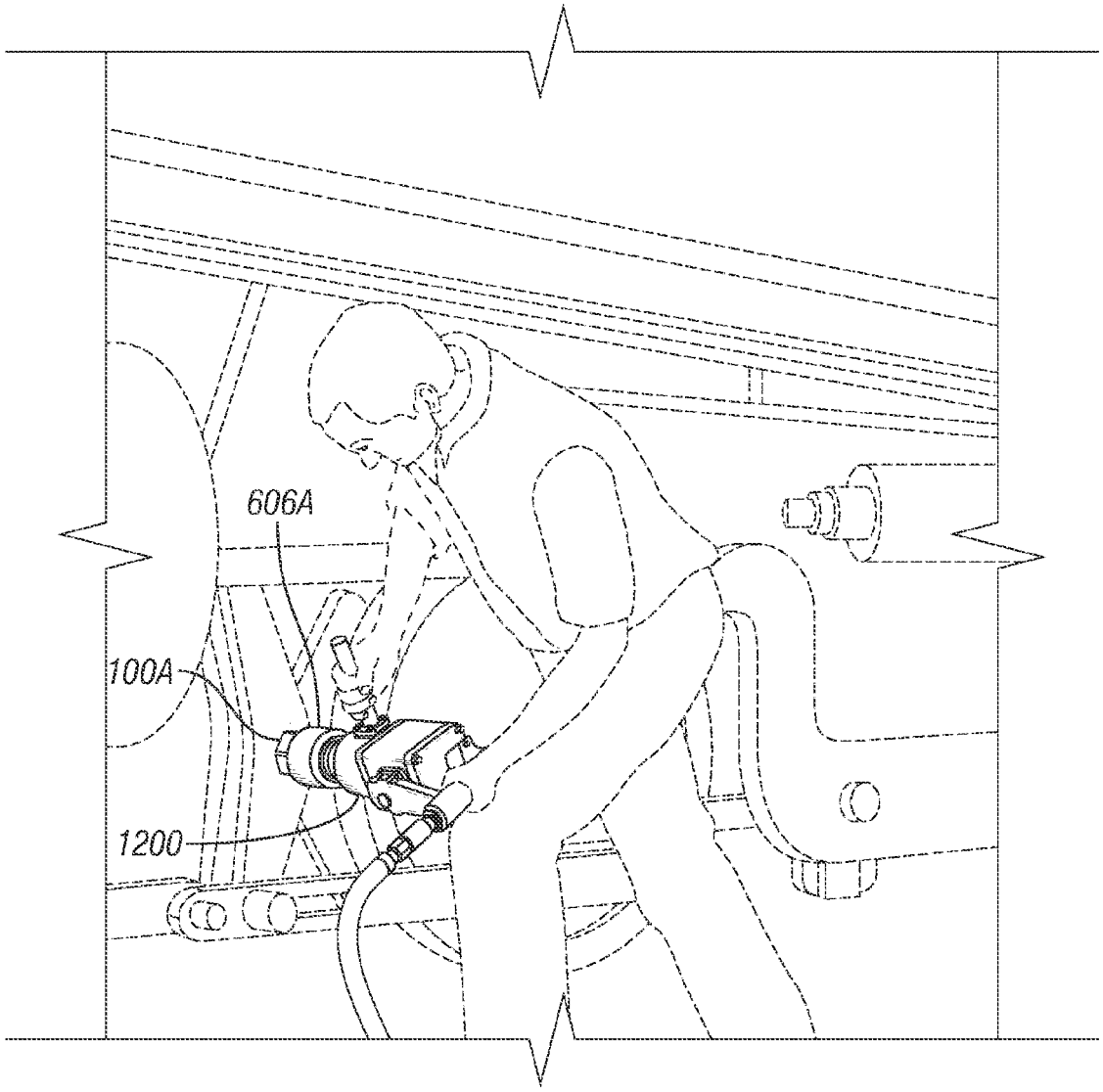
FIG. 12A is a perspective view of a pneumatic impact wrench applying the socket insert adapter, according to some embodiments, to a large nut of a locomotive engine.
Figure 12B:
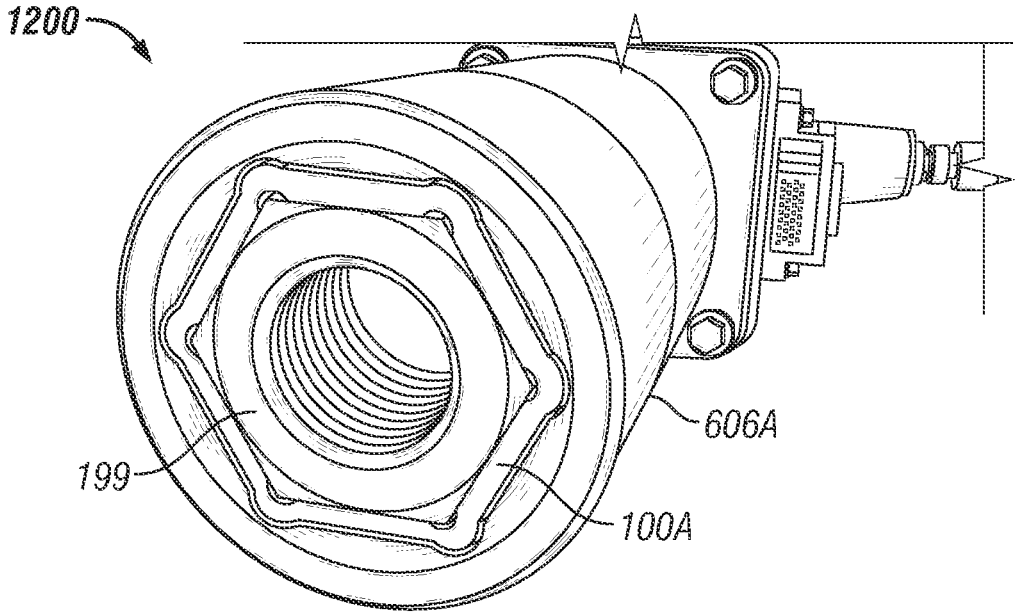
FIG. 12B is close up view of the pneumatic impact wrench of FIG. 12A with a Type I socket insert adapter and socket to be driven.
Figure 12C:
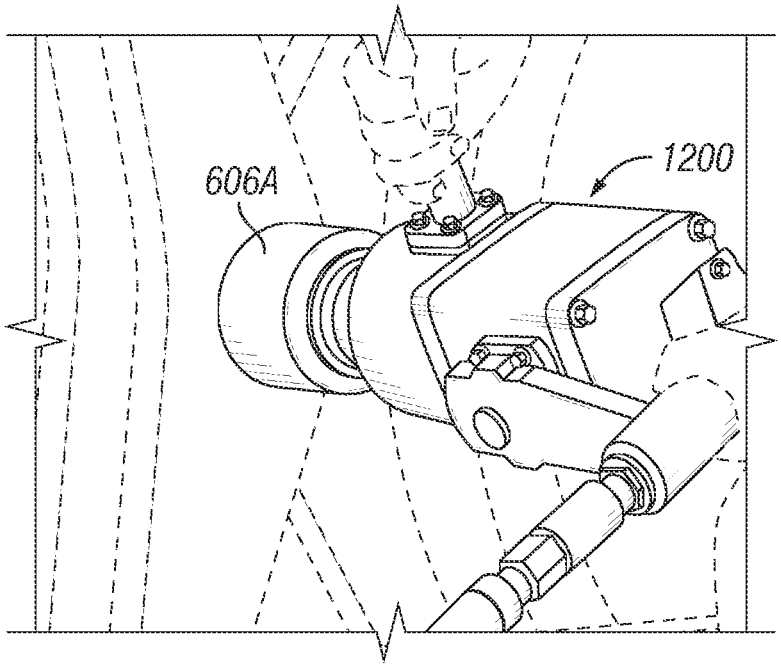
FIG. 12C is a perspective view of a Type 1 insert adapter sliding on the impact socket of FIG. 12A.
Figure 12D:
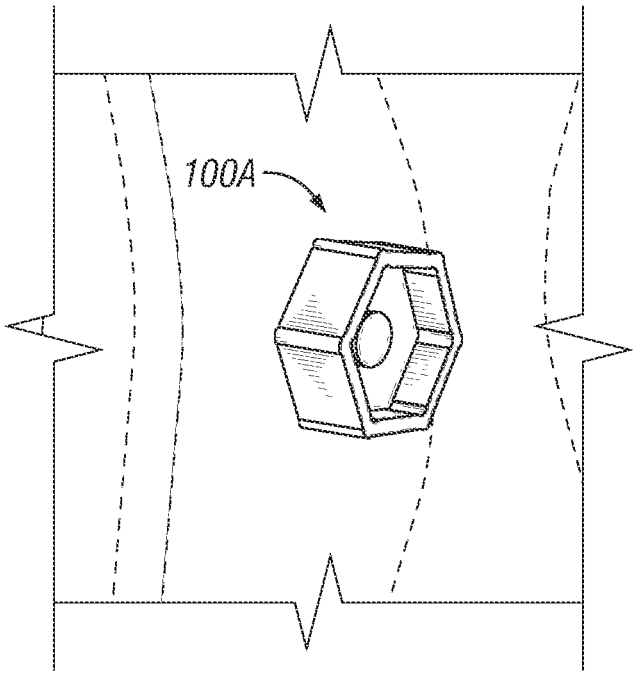
FIG. 12D is a perspective view of the Type 1 insert adapter of FIG. 12C on the wheel assembly of the locomotive engine of FIG. 12A.
Figure 12E:
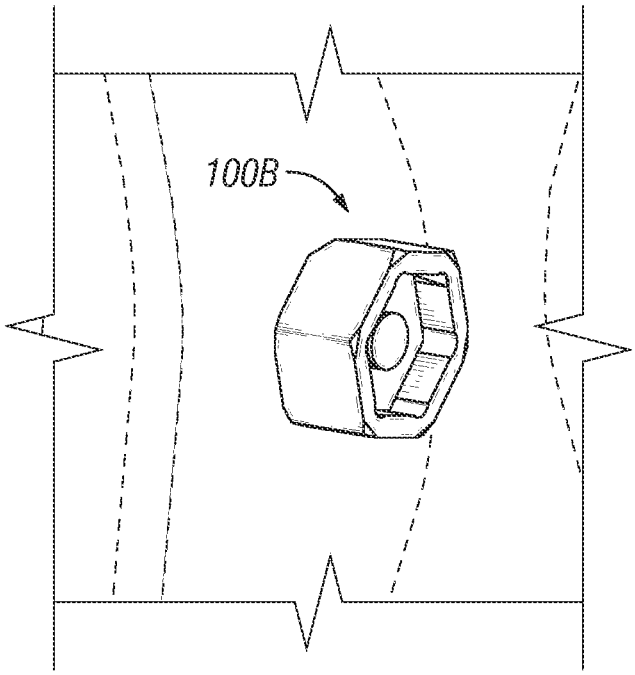
FIG. 12E is a perspective view of the Type 2 insert adapter on the wheel assembly of the locomotive engine of FIG. 12A.

Referring now to FIGS. 12A through 12E, an alternative preferred embodiment is illustrated utilizing a pneumatic impact wrench to apply the socket insert adapter according to step 210 to a locomotive engine. In FIG. 12A, an operator (in phantom) applies pneumatic impact wrench 1200 to socket driver 606A and Type I socket insert adapter 101A. In FIG. 12C a Type 1 insert adapter 100A is depicted mating with impact socket driver 606A. FIG. 12D depicts a Type 1 insert adapter of FIG. 12C on the wheel assembly of the locomotive engine (in phantom) of FIG. 12A and FIG. 12E depicts a Type 2 insert adapter on the wheel assembly of the locomotive engine of FIG. 12A. FIG. 12B depicts the pneumatic impact wrench 1200, socket driver 606A with a Type I socket insert adapter 100A and the nut 199 to be driven. Pneumatic powered impact wrenches, such as the one depicted in FIGS. 12A through 12E can generate maximum torque up to 107,000 Newton meters, or 80,000 ft/lbs.

Figure 13A:
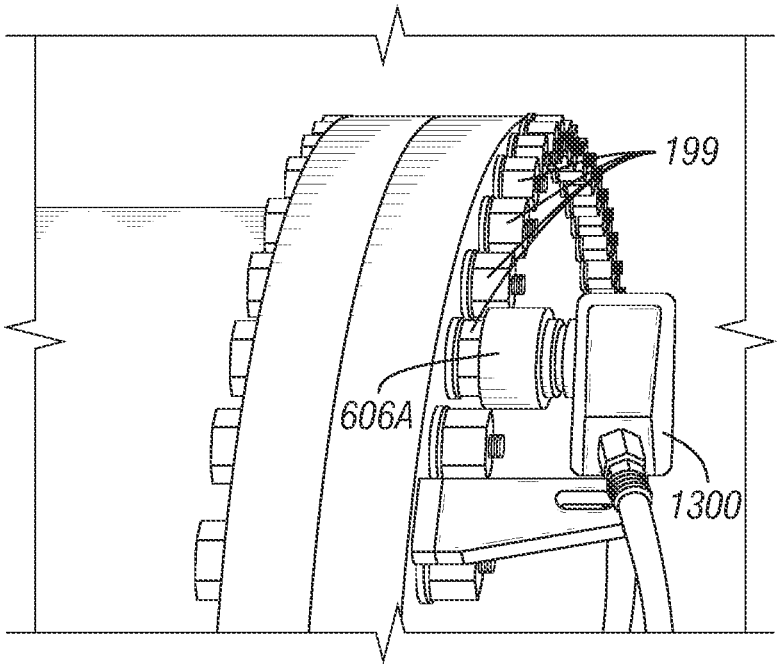
FIG. 13A is a perspective view of a hydraulic impact wrench applying the socket insert adapter of the present invention.
Figure 13B:
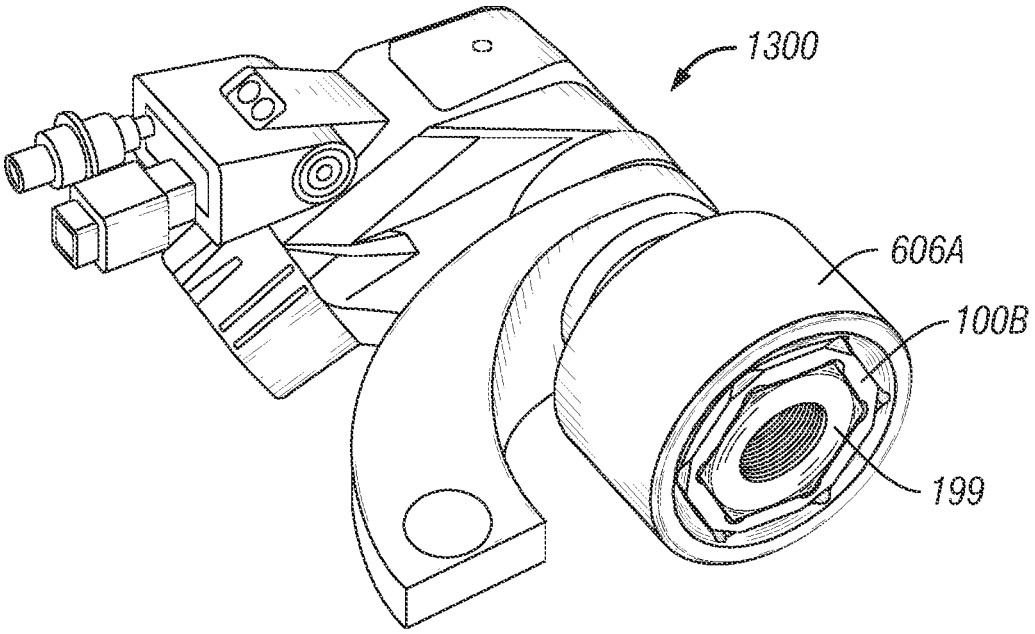
FIG. 13B is a view of the hydraulic impact wrench of FIG. 13A showing a socket driver mated with a Type 2 insert adapter mated with a nut to be driven.

Referring now to FIGS. 13A and 13B, an alternative preferred embodiment is illustrated utilizing a hydraulic impact wrench to apply the socket insert adapter according to step 210. In FIG. 13A, an operator (not shown) applies hydraulic impact wrench 1300 to socket driver 606A and Type I socket insert adapter 101A. FIG. 13B provides a magnified view of hydraulic impact wrench 1300 utilizing socket driver 606A with Type 2 socket insert adapter 100B mated with nut 199. Hydraulic powered impact wrench, such as the one depicted in FIGS. 13A through 13C operate in the range of 100 to over 138,000 ft/lbs.

Powered impact wrenches operate in torque ranges well above any wrench that is only manually operated. While an electrical, hydraulic, or pneumatically driven versions could apply a range of torque forces, one skilled in the art would easily recognize, after reading the above, that at least some of the torque ranges for the above electrical, hydraulic, or pneumatically driven drivers would be beyond what could typically be applied by manual or human force on a manually driven driver. That is, at least some of the above-discussed electrically, hydraulically, or pneumatically driven drivers would apply a torque beyond the torque that could be applied by manual or human force on a manually driven driver. For example, a very strong human applying legs, arms and back optimally placed and braced against a wall, could generate a force of around 500 ft/lbs for a short period of time. In some embodiments, a socket insert adapter can absorb more than 500 ft/lbs of torque—more than what could typically be applied manually—from a powered impact wrench. In some embodiments, a socket insert adapter can absorb more than 4000 ft/lbs of torque from a powered impact wrench. In some embodiments using a pneumatic powered impact wrench, a socket insert adapter can absorb up to 80,000 ft/lbs and hydraulic wrenches, acting on the socket insert adapter of the present invention, can exert a force of over 138,000 ft/lbs.

The socket insert adapter of the present invention with its two sided (interior and exterior) precision tolerance sizing itself to the high torque, is particularly suited for industrial classification as to scope and purpose. Optimally, both interior as well as the exterior surfaces are in contact with the socket to be acted on for action or optimal operation. Type 1 socket insert adapters, with outer convex radii at face intersections and Type 2 socket insert adapters, with all flat intersecting planes on the exterior faces, both accommodate high torque (greater than 1000 ft/lbs) socket wrench designs having similar arrangement of faces at their interiors. All Type 1, Type 2, and Type 3 designs have concave radii at interior corner intersections.

The hollow shaped socket insert adapters described in the invention fulfill the objects set forth at the beginning of the description and provide means whereby a single socket driver/socket wrench may be employed to operate on a large range of nuts/bolts of different size and shapes at a substantial saving in weight, space, and cost.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A mechanical arrangement comprising:

a) a plurality of hollow-shaped socket insert adapters configured to be rotatively driven by a socket driver for at least driving nuts and/or bolts of various sizes, a given one hollow-shaped socket insert adapter of the plurality of hollow-shaped socket insert adapters including at least:

1) an inner configuration that has a shape and size to conform to and to fit on a head portion of a given nut or bolt to be driven;

2) an outer configuration that in at least one end view defines two or more outer flat walls and one or more non-protruding rounded outer corners, at least two outer flat walls of the two or more outer flat walls being coupled, in the at least one end view, at least partly via a non-protruding rounded outer corner of the one or more non-protruding rounded outer corners, the outer configuration shaped to allow the one or more outer flat walls of the outer configuration to contact and engage, and the one or more non-protruding rounded outer corners to avoid contacting and engaging, one or more inner walls defining a cavity of a socket driver body of the socket driver, wherein the at least one end view is orthogonal to a diameter defined by the outer configuration.

2. The mechanical arrangement of claim 1, wherein the inner configuration of the given one hollow-shaped socket insert adapter of the plurality of hollow-shaped socket insert adapters includes at least one or more inner flat walls and one or more rounded inner corners, the inner configuration shaped to allow the one or more inner flat walls of the inner configuration to contact and engage and the one or more rounded inner corners to avoid contacting and engaging the head portion of the given nut or bolt to be driven.

3. The mechanical arrangement of claim 2, wherein the one or more rounded inner corners of the inner configuration are configured to prevent spinning and slipping when the given one hollow-shaped socket insert adapter is contacting and engaging the head portion of the given nut or bolt to be driven.

4. The mechanical arrangement of claim 1, wherein the plurality of hollow-shaped socket insert adapters are configured to be rotatively driven by the socket driver and to receive a torque force via the socket driver from at least one of electrical, hydraulic, or pneumatic means, wherein the torque force is greater than 1,000 foot pounds.

5. The mechanical arrangement of claim 4, wherein the plurality of hollow-shaped socket insert adapters are configured to be rotatively driven by the socket driver and to receive a torque force via the socket driver from at least one of hydraulic or pneumatic means, wherein the torque force is greater than 4,000 foot pounds.

6. The mechanical arrangement of claim 1 , wherein a number of the one or more outer flat walls of the outer configuration of the given one hollow-shaped socket insert adapter is equal to a number of the one or more inner walls defining the cavity of the socket driver body of the socket driver.

7. The mechanical arrangement of claim 1, wherein:

the given one hollow-shaped socket insert adapter defines a plurality of at least five holes, extending from a given inner flat wall of one more inner flat walls defined by the inner configuration to a given outer flat wall of one or more outer flat walls defined by the outer configuration; and the given one hollow-shaped socket insert adapter is configured to be rotatively driven by the socket driver and to receive a torque force via the socket driver from at least one of electrical, hydraulic, or pneumatic means, wherein the torque force is greater than 1,000 foot pounds.

8. The mechanical arrangement of claim 1, wherein the shape of the inner configuration of the given one hollow-shaped socket insert adapter of the plurality of hollow-shaped socket insert adapters is a closed hollow shape selected from one of square, pentagonal, hexagonal, decagonal, or dodecagonal.

9. The mechanical arrangement of claim 1, wherein the given one hollow-shaped socket insert adapter of the plurality of hollow-shaped socket insert adapters is employed to rotate nuts/bolts of sizes smaller than a size of the cavity of the socket driver body of the socket driver.

10. The mechanical arrangement of claim 1, wherein the given one hollow-shaped socket insert adapter of the plurality of hollow-shaped socket insert adapters is enabled to accommodate nuts/bolts of interchangeable SAE to metric dimensions.

11. The mechanical arrangement of claim 1, wherein the one or more non-protruding rounded outer corners of the outer configuration of the given one hollow-shaped socket insert adapter of the plurality of hollow-shaped socket insert adapters are configured to reduce spinning and slipping when the given one hollow-shaped socket insert adapter is rotatively driven by the socket driver.

12. The mechanical arrangement of claim 1, wherein the inner configuration of the given one hollow-shaped socket insert adapter of the plurality of hollow-shaped socket insert adapters has a shape similar to a shape of the given nut or bolt to be driven and the given nut or bolt has a size chosen from among 4 point, 5 point, 6 point, 7 point, 8 point, 10 point, or 12 point.

13. The mechanical arrangement of claim 1, wherein the size of the inner configuration of the given one hollow-shaped socket insert adapter of the plurality of hollow-shaped socket insert adapters varies from 1 inch to $12^{7/8}$ inches.

14. The mechanical arrangement of claim 1, wherein the size of the inner configuration of the given one hollow-shaped socket insert adapter of the plurality of hollow-shaped socket insert adapters varies from 23 mm to 327 mm.

15. The mechanical arrangement of claim 1, wherein the given one hollow-shaped socket insert adapter of the plurality of hollow-shaped socket insert adapters is configured for use with a spring ball detent for securely holding the given one socket insert adapter inside the cavity of the socket driver body of the socket driver.

16. The mechanical arrangement of claim 1, wherein the at least one end view includes at least a front view of the outer configuration, the front view being orthogonal to the at least one diameter defined by the outer configuration.

17. A mechanical arrangement comprising:

a socket driver;

a plurality of hollow-shaped socket insert adapters configured to be rotatively driven by the socket driver for at least driving nuts and/or bolts of various sizes, a given one hollow-shaped socket insert adapter of the plurality of hollow-shaped socket insert adapters including at least:

1) an outer configuration that in at least one end view defines two or more outer flat walls and one or more non-protruding rounded outer corners, at least two outer flat walls of the two or more outer flat walls being coupled, in the at least one end view, at least partly via a non-protruding rounded outer corner of the one or more non-protruding rounded outer corners, the outer configuration shaped to allow the one or more outer flat walls of the outer configuration to contact and engage, and the one or more non-protruding rounded outer corners to avoid contacting and engaging, one or more inner walls defining a driver cavity of a socket driver body of the socket driver, wherein the at least one end view is orthogonal to a diameter defined by the outer configuration; and 2) an inner configuration that has a shape and size to conform to and to fit on a head portion of a given nut or bolt to be driven; and the driver body of the socket driver, the driver body including at least the one or more inner walls that define the driver cavity, the one or more inner walls that define the driver cavity further defining one or more rounded inner corners, the cavity of the socket driver being shaped to allow the one or more inner walls to contact and engage, and the one or more rounded inner corners to avoid contacting and engaging, the outer configuration of the given one hollow-shaped socket insert adapter of the plurality of hollow-shaped socket insert adapters.

18. The mechanical arrangement of claim 17, wherein the inner configuration of the given one hollow-shaped socket insert adapter of the plurality of hollow-shaped socket insert adapters includes at least one or more inner flat walls and one or more rounded inner corners, the inner configuration being shaped to allow the one or more inner flat walls of the inner configuration to contact and engage and the one or more rounded inner corners to avoid contacting and engaging the head portion of the given nut or bolt to be driven.

19. The mechanical arrangement of claim 17, wherein the plurality of hollow-shaped socket insert adapters are configured to be rotatively driven by the socket driver and to receive a torque force via the socket driver from at least one of electrical, hydraulic, or pneumatic means, wherein the torque force is greater than 1,000 foot pounds.

20. The mechanical arrangement of claim 19, wherein the plurality of hollow-shaped socket insert adapters are configured to be rotatively driven by the socket driver and to receive a torque force via the socket driver from at least one of hydraulic or pneumatic means, wherein the torque force is greater than 4,000 foot pounds.

21. The mechanical arrangement of claim 17, wherein the given one hollow-shaped socket insert adapter defines a plurality of at least five holes, extending from a given inner flat wall of one more inner flat walls defined by the inner configuration to a given outer flat wall of one or more outer flat walls defined by the outer configuration; and the given one hollow-shaped socket insert adapter is configured to be rotatively driven by the socket driver and to receive a torque force via the socket driver from at least one of electrical, hydraulic, or pneumatic means, wherein the torque force is greater than 1,000 foot pounds.

22. The mechanical arrangement of claim 17, wherein the shape of the inner configuration of the given one hollow-shaped socket insert adapter of the plurality of hollow-shaped socket insert adapters is a closed hollow shape selected from one of square, pentagonal, hexagonal, decagonal, or dodecagonal.

23. The mechanical arrangement of claim 17, wherein the socket driver includes a shape of at least one of box end wrench, open end wrench, closed-end wrench, socket wrench or any combination thereof.

24. The mechanical arrangement of claim 17, wherein the given one hollow-shaped socket insert adapter of the plurality of hollow-shaped socket insert adapters is employed to rotate nuts/bolts of sizes smaller than a size of the cavity defined by the socket driver body of the socket driver.

25. The mechanical arrangement of claim 17, wherein the given one hollow-shaped socket insert adapter of the plurality of hollow-shaped socket insert adapters is enabled to accommodate nuts/bolts of interchangeable SAE to metric dimensions.

26. The mechanical arrangement of claim 17, wherein the inner configuration of the given one hollow-shaped socket insert adapter of the plurality of hollow-shaped socket insert adapters has a shape similar to a shape of the given nut or bolt to be driven and the given nut or bolt has a size chosen from among 4 point, 5 point, 6 point, 7 point, 8 point, 10 point, or 12 point.

27. The mechanical arrangement of claim 17, wherein the size of the inner configuration of the given one hollow-shaped socket insert adapter of the plurality of hollow-shaped socket insert adapters varies from 1 inch to $12^{7/8}$ inches.

28. The mechanical arrangement of claim 17, wherein the size of the inner configuration of the given one hollow-shaped socket insert adapter of the plurality of hollow-shaped socket insert adapters varies from 23 mm to 327 mm.

29. A mechanical arrangement comprising:

a plurality of hollow-shaped socket insert adapters configured to be rotatively driven by a socket driver for at least driving nuts and/or bolts of various sizes, a given one hollow-shaped socket insert adapter of the plurality of hollow-shaped socket insert adapters including at least:

1) an inner configuration that:

has a shape and size to conform to and to fit on a head portion of a given nut or bolt to be driven; and includes at least one or more inner flat walls and one or more rounded inner corners, the inner configuration being shaped to allow the one or more inner flat walls of the inner configuration to contact and engage and the one or more rounded inner corners to avoid contacting and engaging the head portion of the given nut or bolt to be driven;

2) an outer configuration that in at least one end view defines two or more outer flat walls and one or more non-protruding rounded outer corners, at least two outer flat walls of the two or more outer flat walls being coupled, in the at least one end view, at least partly via a non-protruding rounded outer corner of the one or more non-protruding rounded outer corners, the outer configuration shaped to allow the one or more outer flat walls of the outer configuration to contact and engage, and the one or more non-protruding rounded outer corners to avoid contacting and engaging, one or more inner walls defining a cavity of a socket driver body of the socket driver, wherein the at least one end view is orthogonal to a diameter defined by the outer configuration, wherein the outer configuration also defines one or more chamfers.

30. The mechanical arrangement of claim 29, wherein the one or more chamfers of the outer configuration of the given one hollow-shaped socket insert adapter are configured to ease insertion into and extraction from the cavity defined by the one or more inner walls of the socket driver body of the socket driver.

31. The mechanical arrangement of claim 30, wherein the one or more chamfers of the outer configuration of the given one hollow-shaped socket insert adapter are configured to guide the outer configuration into the cavity defined by the one or more inner walls of the socket driver body of the socket driver.

* * * * *